US009201342B2

(12) United States Patent
Hirasawa

(10) Patent No.: US 9,201,342 B2
(45) Date of Patent: Dec. 1, 2015

(54) TONER FOR ELECTROSTATIC-IMAGE DEVELOPMENT AND TONER CARTRIDGE CONTAINING THE SAME THEREIN

(71) Applicant: MITSUBISHI CHEMICAL CORPORATION, Chiyoda-ku (JP)

(72) Inventor: Hirohiko Hirasawa, Niigata (JP)

(73) Assignee: MITSUBISHI CHEMICAL CORPORATION, Chiyoda-ku (JP)

( * ) Notice: Subject to any disclaimer, the term of this patent is extended or adjusted under 35 U.S.C. 154(b) by 0 days.

(21) Appl. No.: 14/500,384

(22) Filed: Sep. 29, 2014

(65) Prior Publication Data

US 2015/0050591 A1 Feb. 19, 2015

Related U.S. Application Data

(63) Continuation of application No. PCT/JP2013/056519, filed on Mar. 8, 2013.

(30) Foreign Application Priority Data

Mar. 29, 2012 (JP) ..... 2012-076125

(51) Int. Cl.
*G03G 15/08* (2006.01)
*G03G 9/08* (2006.01)

(52) U.S. Cl.
CPC ..... *G03G 15/0865* (2013.01); *G03G 9/0819* (2013.01); *G03G 9/0821* (2013.01); *G03G 9/0823* (2013.01); *G03G 15/0812* (2013.01)

(58) Field of Classification Search
CPC ... G03G 9/0819; G03G 9/0821; G03G 9/081; G03G 9/0827; G03G 9/08755; G03G 9/08795; G03G 9/08797; G03G 15/0812; G03G 15/0865; G03G 9/0823
See application file for complete search history.

(56) References Cited

U.S. PATENT DOCUMENTS

| | | | | |
|---|---|---|---|---|
| 6,063,535 | A * | 5/2000 | Tsutsui et al. | 430/101 |
| 2004/0126692 | A1 | 7/2004 | Yamanouchi et al. | |
| 2009/0047043 | A1* | 2/2009 | Dojo et al. | 399/252 |
| 2013/0164044 | A1* | 6/2013 | Hasegawa et al. | 399/274 |

FOREIGN PATENT DOCUMENTS

| | | |
|---|---|---|
| JP | 2000-47432 | 2/2000 |
| JP | 2000-047432 | 2/2000 |
| JP | 2002-49181 | 2/2002 |
| JP | 2002-049181 | 2/2002 |

(Continued)

OTHER PUBLICATIONS

International Search Report issued Apr. 16, 2013 in PCT/JP2013/056519 filed Mar. 8, 2013.

*Primary Examiner* — Roy Y Yi
(74) *Attorney, Agent, or Firm* — Oblon, McClelland, Maier & Neustadt, L.L.P.

(57) ABSTRACT

The object of the invention is to provide a toner for electrostatic-image development which imparts excellent image quality and a toner cartridge employing the toner. The invention relates to a toner for electrostatic-image development, which satisfies the following requirements (1) and (2): (1) the toner has an average transporting property of 2.9 to 15.1 mg/sec; and (2) the product of the BET specific surface area ($m^2/g$) and volume-average particle diameter (μm) of the toner is $7.7\times10^{-6}$ to $11.0\times10^{-6}$ ($m^3/g$).

2 Claims, 3 Drawing Sheets

(56) References Cited

FOREIGN PATENT DOCUMENTS

| | | |
|---|---|---|
| JP | 2003-280242 | 10/2003 |
| JP | 2004-109603 | 4/2004 |
| JP | 2004-341362 | 12/2004 |
| JP | 2007-206482 | 8/2007 |
| JP | 2007-248913 | 9/2007 |
| JP | 2008-96623 | 4/2008 |
| JP | 2008-225174 | 9/2008 |

* cited by examiner

TONER FOR ELECTROSTATIC-IMAGE DEVELOPMENT AND TONER CARTRIDGE CONTAINING THE SAME THEREIN

CROSS REFERENCE TO RELATED APPLICATION

This application is a continuation of PCT/JP2013/056519, filed on Mar. 9, 2013, and claims priority to Japanese Patent Application 2012-076125, filed on Mar. 29, 2012.

TECHNICAL FIELD

The present invention relates to a toner for electrostatic-image development which is for use in electrophotography, electrostatic photography, etc., and a toner cartridge which employs the toner.

BACKGROUND ART

Electrophotography generally includes the steps of forming an electrostatic latent image on a photoconductive photoreceptor by any of various methods, subsequently making the latent image visible using a toner for electrostatic-image development (hereinafter abbreviated to "toner"), thereafter transferring the visible toner image to a receiving material, e.g., paper, and fixing the toner image by heating, pressing, etc. Various methods are known as these steps, and methods suitable for the respective image forming processes are being adopted.

Known toners include: a two-component toner configured of a carrier and a toner; and a one-component toner in which no carrier is required (magnetic toner, nonmagnetic toner). The nonmagnetic toner contains a binder resin as a main component, while the magnetic toner contains a binder resin and a magnetic powder as main components. A colorant (pigment), charge control agent, wax, etc. are further contained dispersedly therein besides the binder resin.

As shown in FIG. 1, a toner cartridge which contains a toner therein is equipped with a developing roller 3 for supporting the toner 1 thereon, a charging member (charging blade) 2 disposed on the upper side of the developing roller 3, a retaining blade 4 disposed on the lower side of the developing roller 3 so as to face the developing roller 3 at a predetermined distance, a photoreceptor 7 to which the toner 1 supplied by the developing roller 3 is transferred, a charging roller 5 which has been disposed on the upper side of the photoreceptor 7 and which charges the photoreceptor 7, and a cleaning member (wiper blade) 6 which has been disposed below the charging roller 5 and which removes any toner remaining on the photoreceptor 7. The charging member (charging blade) 2 serves not only to control the amount of the toner 1 to be supported on the surface of the developing roller 3 and conveyed to the photoreceptor 7 but also to frictionally charge the toner 1.

As shown in FIG. 2, the toner cartridge of FIG. 1, i.e., the toner cartridge having a configuration wherein the charging member (charging blade) 2 has been disposed on the upper side of the developing roller 3, is disposed on the upper side of the intermediate transfer belt 9 in an image forming apparatus. In FIG. 2, numeral 10 denotes a transfer roller, which serves to transfer an image to the transfer roller 10, the image having been transferred to the surface of the intermediate transfer belt 9 by successively superposing toners supplied by four toner cartridges 8 which have been disposed on the upper side of the intermediate transfer belt 9 and in which toners of four colors (yellow, magenta, cyan, and black) are contained.

Besides such cartridges, there is a toner cartridge in which a charging member and a retaining blade have been disposed in an arrangement which is vertically reverse to that in the toner cartridge shown in FIG. 1. Namely, as shown in FIG. 3, this toner cartridge includes a charging member (charging blade) 16 disposed on the lower side of the developing roller 12 and a retaining blade 11 disposed on the upper side of the developing roller 12. Incidentally, in the toner cartridge shown in FIG. 3, the toner 13 retained below the developing roller 12 is supplied to the developing roller 12 by means of a stirring blade 15 and a feed roller 14 disposed so as to be in sliding contact with the developing roller 12. Like the toner cartridge shown in FIG. 1, the toner cartridge shown in FIG. 3 is equipped with a photoreceptor 17 to which the toner supplied by the developing roller is transferred. The toner cartridge shown in FIG. 3 is equipped with the photoreceptor 17, a charging roller 19, and a cleaning member (wiper blade) 18 which has been disposed above the charging roller 19 and which removes any toner remaining on the photoreceptor 17, so that the arrangement of these members is reverse to that in the toner cartridge shown in FIG. 1.

As shown in FIG. 4, the toner cartridge of FIG. 3, i.e., the toner cartridge having a configuration wherein the charging member (charging blade) 16 has been disposed on the lower side of the developing roller 12, is disposed on the lower side of the intermediate transfer belt 21 in an image forming apparatus. In FIG. 4, numeral 22 denotes a transfer roller, and 20 denotes four toner cartridges 20 which have been disposed on the lower side of the intermediate transfer belt 21 and in which toners of four colors (yellow, magenta, cyan, and black) are contained.

In general, image failure items directly attributable to toners include ghost, dust (fogging), following-up failure, density unevenness, decrease in density, and the like. Disclosed in patent document 1, as a measure against these image failures, is a toner which has specific shape properties imparted thereto and has a transportability index regulated so as to be within a specific range and which therefore stably gives images of high quality.

PRIOR-ART DOCUMENT

Patent Document

Patent Document 1: JP-A-2004-109603

SUMMARY OF THE INVENTION

Problem that the Invention is to Solve

However, in the case of cartridges which differ in the arrangement of members, toner leakage troubles may occur. Specifically, in the case of a toner cartridge in which the retaining blade 4 has been disposed on the lower side of the developing roller 3, such as the cartridge shown in FIG. 1, there is the following problem. In case where the retaining blade 4 deforms, for example, during recycling of the toner cartridge, this retaining blade 4 comes to be more lightly pushed against the developing roller 3, resulting in a higher possibility that the toner 1 might leak from the toner cartridge (FIG. 5). The toner which has leaked from the toner cartridge falls onto the intermediate transfer belt 9 and is conveyed to the transfer roller 10, as shown in FIG. 2. As a result, the toner which has leaked from the toner cartridge adheres to the back of the paper via the transfer roller 10 to cause back soils.

The present invention proposes a toner for electrostatic-image development which is inhibited from leaking out and can be prevented from causing back soils and which imparts excellent image quality, and further proposes a toner cartridge which is equipped with a retaining blade disposed on the lower side of the developing roller and in which the toner for electrostatic-image development is contained.

Incidentally, in patent document 1, the trouble of toner leakage which occurs especially in the case where cartridge members are disposed in different arrangements as in the present invention is not supposed. Document 1 neither discloses nor suggests any means for solving the trouble.

Means for Solving the Problem

The present inventors diligently made investigations and, as a result, have found that a toner for electrostatic-image development can be inhibited from leaking out and prevented from causing back soils and imparts excellent image quality, in cases when the toner satisfies specific numerical values.

[1] The invention provides a toner for electrostatic-image development, which satisfies the following requirements (1) and (2):

(1) the toner has an average transporting property of 2.9 to 15.1 mg/sec; and (2) the product of the BET specific surface area ($m^2/g$) and volume-average particle diameter (μm) of the toner is $7.7\times10^{-6}$ to $11.0\times10^{-6}$ ($m^3/g$).

[2] The invention provides the toner for electrostatic-image development according to [1] above, which has a loosened apparent density of 0.342 to 0.425 $g/cm^3$.

[3] The invention provides a toner cartridge comprising: the toner for electrostatic-image development according to claim 1 or 2; a developing roller for supporting the toner for electrostatic-image development thereon; a charging blade disposed on the upper side of the developing roller; and a retaining blade disposed on the lower side of the developing roller so as to face the developing roller at a predetermined distance.

Effects of the Invention

According to the invention, it is possible to provide: a toner for electrostatic-image development which can be inhibited from leaking out and prevented from causing back soils and which imparts excellent image quality; and a toner cartridge which is equipped with a retaining blade disposed on the lower side of the developing roller and in which the toner for electrostatic-image development is contained.

In the trend in merchandise toward machine size reduction, developing rollers are required to be reduced in size. Meanwhile, the developing roller having a reduced diameter has enhanced curvature and forms an enlarged angle with the retaining blade, resulting in the higher possibility of the falling of toner masses. The toner of the invention is expected to effectively function especially as a toner for use in compact cartridges.

In this description, the "retaining blade" is a member mounted in a cartridge so as to be in contact with the developing roller with a toner present therebetween, and serves to prevent the toner from leaking out of the cartridge.

MODES FOR CARRYING OUT THE INVENTION

Figure 1:
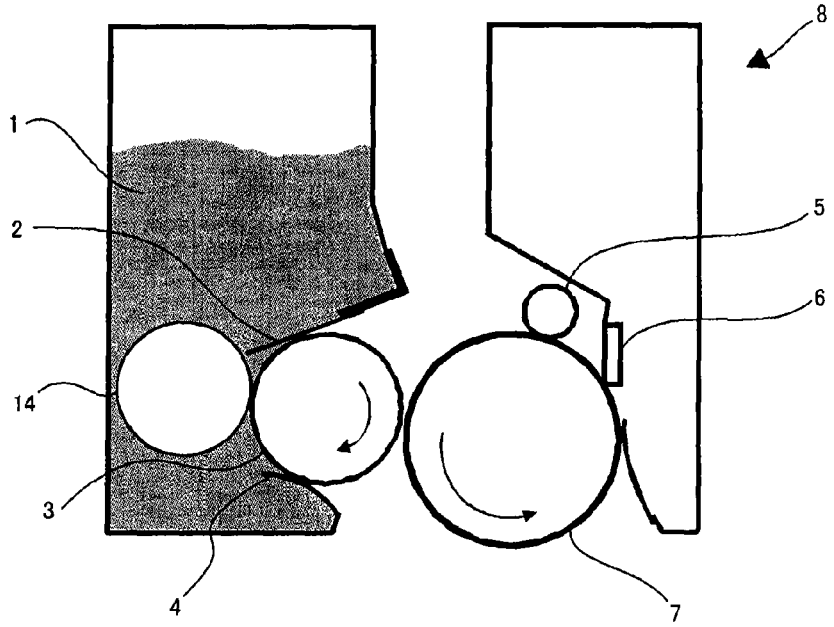
FIG. 1 is a schematic view showing the internal structure of a toner cartridge in which a retaining blade has been disposed on the lower side of the developing roller.
Figure 2:
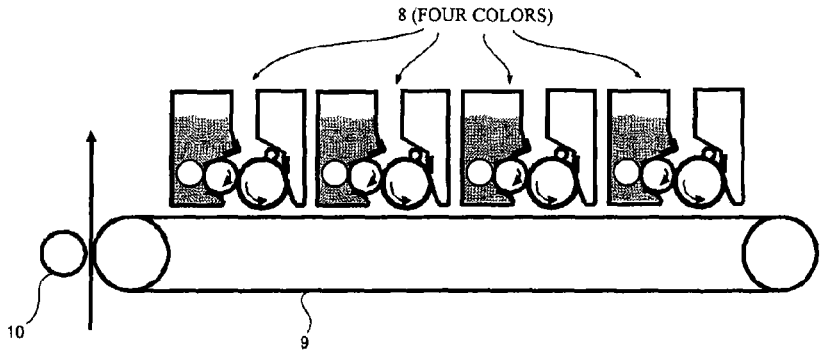
FIG. 2 is a schematic view showing a relationship between the inner structure of toner cartridges each including a retaining blade disposed on the lower side of the developing roller and an intermediate transfer belt.
Figure 3:
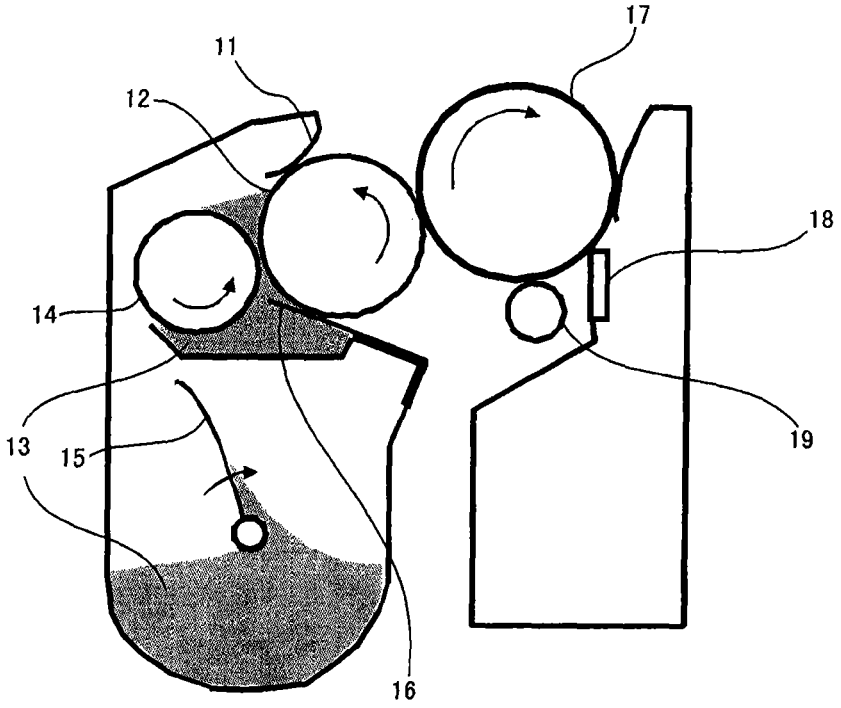
FIG. 3 is a schematic view showing the internal structure of a toner cartridge in which a retaining blade has been disposed on the upper side of the developing roller.
Figure 4:
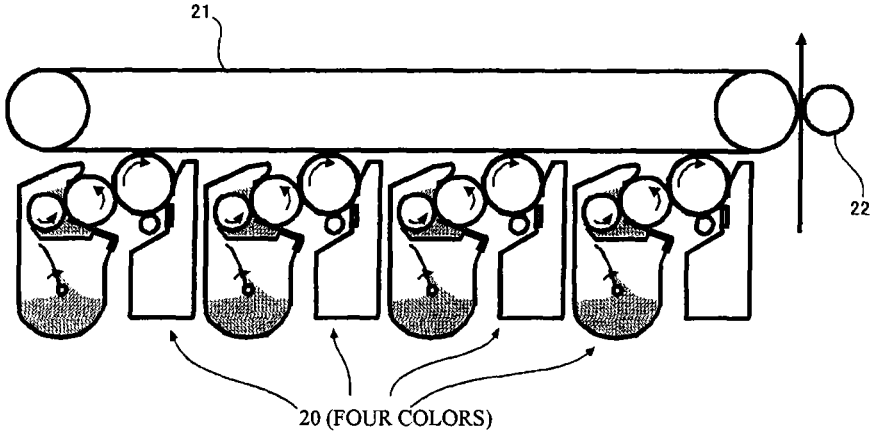
FIG. 4 is a schematic view showing a relationship between the inner structure of toner cartridges each including a retaining blade disposed on the upper side of the developing roller and an intermediate transfer belt.
Figure 5:
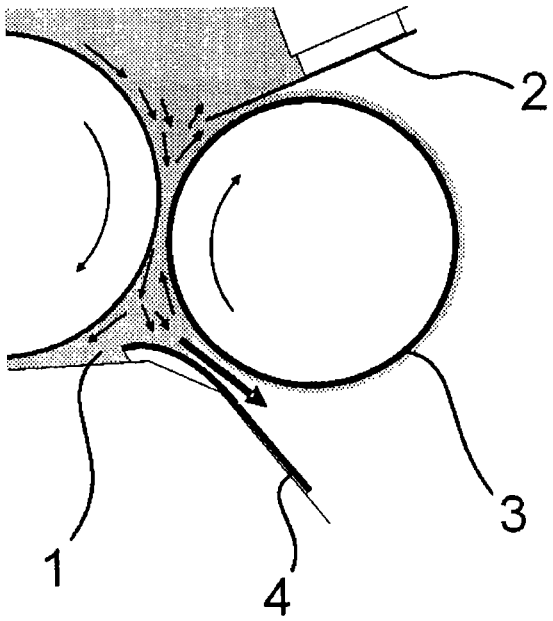
FIG. 5 is a partial enlarged view of a portion of the internal structure of a toner cartridge in which a retaining blade has been disposed on the lower side of the developing roller.

The present invention is explained below. However, the invention should not be construed as being limited to the following embodiments and can be modified at will.

Processes for producing the toner for electrostatic-image development (hereinafter, often abbreviated to "toner for development" or "toner") of the invention are not particularly limited, and the configurations which will be explained below may be employed in a process for producing a wet-process toner or pulverization toner.

In this description, "% by weight" and "parts by weight" have the same meanings as "% by mass" and "parts by mass", respectively. The mere expression "parts" means "parts by weight".

[Toner for Electrostatic-Image Development]

The toner for electrostatic-image development of the invention is a toner for electrostatic-image development characterized by satisfying the following requirements (1) and (2):

(1) the toner has an average transporting property of 2.9 to 15.1 mg/sec; and (2) the product of the BET specific surface area ($m^2/g$) and volume-average particle diameter (μm) of the toner is $7.7\times10^{-6}$ to $11.0\times10^{-6}$ ($m^3/g$).

The average transporting property is an index to coherence between the toner and wall surfaces which varies depending on differences of the cohesiveness and frictional property of the toner particles.

The "average transporting property" herein is an index obtained from the movability of toner particles in the state of being oscillated under given conditions, the movability being obtained by examining the toner particles by means of, for example, an oscillation transportation type flowability tester manufactured by Etowas Co., Ltd. The average transporting property indicates the ability of the toner to be transported, i.e., the ability of the toner to move.

Specifically, a toner for electrostatic-image development to be examined, which is composed of toner base particles and external additives, is first introduced into an oscillation transportation type flowability tester (oscillation transportation type flowability tester manufactured by Etowas Co., Ltd.). With this oscillation transportation type flowability tester, the flowability of the whole toner particles can be determined from the shape of the toner, state of the external additives, etc. by oscillating the toner placed in the bowl.

In the invention, the average transporting property of a toner is determined in the following manner. First, 1 g of the toner is introduced into the oscillation transportation type flowability tester, and the driving device is operated under the conditions of a frequency of 135 Hz. Next, the toner is allowed to move above along the ramp and enter the receiving pan. At the time when the amount of the toner which has entered the receiving pan, the amount being determined with a measuring means, has increased from 300 mg to 750 mg, the time period from initiation of the operation of the driving device is measured. The average transporting property can be then calculated using the following general formula.

$$(\text{Average transporting property})=[(750-300)\ \text{mg}]/[(T750-T300)\ \text{sec}]$$

In the general formula, T300 indicates the time period required for transporting 300 mg of the toner of the receiving pan, and T750 indicates the time period required for transporting 750 mg of the toner to the receiving pan.

The average transporting property thereof be from 2.9 mg/sec to 15.1 mg/sec.

In case where the average transporting property thereof is less than 2.9 mg/sec, this toner in itself has too high flowability and, hence, there are cases where the falling of toner masses from the toner cartridge occurs to cause back soils. In case where the average transporting property thereof exceeds 15.1 mg/sec, this toner has low transportability and, hence, there are cases where toner following-up failures occur, resulting in unevenness in image density and blurring.

The product of the BET specific surface area ($m^2/g$) and volume-average particle diameter (μm) of the toner of the invention is $7.7\times10^{-6}$ to $11.0\times10^{-6}$ ($m^3/g$).

Here, the "BET" specific surface area" is the specific surface area determined by a gas adsorption method (BET method) in which particles of a gas such as nitrogen are adsorbed onto solid particles and the surface area is determined from the number of the molecules. For example, the specific surface area can be determined using Macsorb model-1201, manufactured by Mountech Co., Ltd., by the one-point method using liquid nitrogen.

Furthermore, the "volume-average particle diameter" is the average diameter of volume-weighted particles. For example, the volume-average diameter (Mv) of particles having a volume-average diameter (Mv) less than 1 μm can be determined using Type Microtrac Nanotrac 150 (hereinafter abbreviated to "Nanotrac"), manufactured by Nikkiso Co., Ltd., while the volume-average diameter (Mv) of particles having a volume-average diameter of 1 μm or larger can be determined using Multisizer III (aperture diameter, 100 μm) (hereinafter abbreviated to "Multisizer"), manufactured by Beckman Coulter, Inc. Incidentally, in cases when one powder mass is supposed and a cumulative curve thereof is determined while taking the overall volume of the powder mass as 100%, then the particle diameter corresponding to the point where the cumulative curve is 50% is referred to as cumulative median diameter. The volume-based median diameter (Dv50) of particles having a volume-based median diameter (Dv50) of 1 μm or larger can be determined using Multisizer III (aperture diameter, 100 μm) (hereinafter abbreviated to "Multisizer"), manufactured by Beckman Coulter, Inc.

The product of the BET specific surface area and the average particle diameter is a value used in order to normalize the unevenness in particle diameter of the toner base particles.

The weight of one toner particle which is supposed to be a complete sphere can be calculated using the following formula.

$$4/3\pi r^3\times\rho$$

(In the formula, ρ is specific gravity ($g/m^3$), and r is radius.)

Since the surface area of a sphere is $4\pi r^2$, the BET specific surface area can be expressed by the following equation.

$$\begin{aligned}\text{BET specific surface area} &= (\text{surface area})/(\text{weight})\\ &= 4\pi r^2/(4/3\pi r^3\times\rho)\\ &= 3/r\rho\\ &= 6/d\rho\end{aligned}$$

(In the equation, d is diameter.)

Namely the product of the BET specific surface area and the average particle diameter (d) is 6/ρ (constant).

In case where the product of the BET specific surface area ($m^2/g$) and the volume-average particle diameter (μm) is less than $7.7\times10^{-6}$ ($m^3/g$), this toner has low transportability and, hence, there are cases where toner following-up failures occur, resulting in unevenness in image density and blurring. In case where the product of the BET specific surface area ($m^2/g$) and the volume-average particle diameter (μm) exceeds $11.0\times10^{-6}$ ($m^3/g$), this toner in itself has too high flowability and, hence, there are cases where the falling of toner masses from the toner cartridge occurs to cause back soils.

The loosened apparent density of the toner of the invention is preferably 0.342 to 0.425 $g/cm^3$, more preferably 0.380-0.425 $g/cm^3$. The "loosened apparent density" is also called bulk density; this density is determined by introducing the powder which has been rendered loose by given oscillation into a vessel and calculating the density of the powder from the weight of the powder packed in the volume of the vessel. The higher the flowability of a powder, the more densely the powder is packed and, hence, the larger the value of loosened apparent density thereof.

In case where the loosened apparent density of the toner is less than 0.342 $g/cm^3$, this toner has low transportability and, hence, there are cases where toner following-up failures occur, resulting in unevenness in image density and blurring. In case where the loosened apparent density thereof exceeds 0.425 $g/cm^3$, this toner in itself has too high flowability and hence, there are cases where the falling of toner masses from the toner cartridge occurs to cause back soils.

For regulating the transportability index, product of the BET specific surface area ($m^2/g$) and the volume-average particle diameter (μm), and loosened apparent density of the toner of the invention so as to be within the specific ranges, use can be made of a method in which the amount of a release agent present on the surface of the toner particles is controlled or a method in which those properties are controlled by regulating the shape of the toner or by using external additives. Specifically, it is preferable that an external additive having a small particle diameter and an external additive having a large particle diameter be mixed in given amounts with toner base particles constituted at least of a resin and a colorant, by a technique of multistage mixing at a given rotation speed.

In cases when such external additives have been added, the external additive having a small particle diameter has the effect of improving the flowability of the toner particles themselves and the external additive having a large particle diameter has the effect of lowering the adhesion between the toner particles, i.e., the so-called spacer effect. Since these two effects are obtained without fail, not only this toner retains a certain level of flowability but also the cohesiveness of the toner particles is maintained. Thus, the average transporting property of this toner can be regulated so as to be within the given range.

More specifically, for example, the addition amount of all external additives, per 100 parts by mass of the toner base particles, is preferably 1.0-3.0 parts by mass, more preferably 1.0-2.5 parts by mass. The addition amount of the external additive having a small particle diameter, per 100 parts by mass of the toner base particles, is preferably 0.8-2.5 parts by mass, more preferably 0.9-2.0 parts by mass. The addition amount of the external additive having a large particle diameter, per 100 parts by mass of the toner base particles, is preferably 0.03-0.5 parts by mass. In the case where an external additive having a small particle diameter and an external additive having a large particle diameter are used in combination, the ratio between the addition amounts thereof is preferably such that the addition amount of the external additive having a small particle diameter is 1.6-83.3 parts by mass per 1 part by mass of the external additive having a large particle diameter.

The external additive having a small particle diameter is an external additive having a number-average primary particle diameter of 50 nm or less, preferably 5-25 nm. The term "number-average primary particle diameter" herein means a particle diameter obtained by examining 100 particles with a transmission electron microscope at a magnification of 2,000 diameters and determining an average diameter thereof through an image analysis.

Suitable for use as the material which constitutes fine inorganic particles according to the external additive having a small particle diameter are various inorganic oxides, nitrides, borides, and the like. Specific examples of the fine inorganic particles include silica, alumina, titania, zirconia, barium titanate, aluminum titanate, strontium titanate, magnesium titanate, calcium titanate, zinc oxide, chromium oxide, cerium oxide, antimony oxide, tungsten oxide, tin oxide, tellurium oxide, manganese oxide, boron oxide, silicon carbide, boron carbide, titanium carbide, silicon nitride, titanium nitride, and boron nitride. Preferred of these finely particulate inorganic materials for use as the external additive having a small particle diameter are silica, titania, alumina, and zirconia.

The external additive having a large particle diameter is an external additive having a number-average primary particle diameter of 100 nm or larger, preferably 100-2,000 nm, more preferably 150-1,000 nm. This external additive having a large particle diameter may be constituted of any of fine inorganic particles, fine organic particles, and fine composite particles. The term "number-average primary particle diameter" herein means a particle diameter obtained by examining 100 particles with a transmission electron microscope at a magnification of 2,000 diameters and determining an average diameter thereof through an image analysis.

Suitable for use as the material which constitutes the fine inorganic particles according to the external additive having a large particle diameter are the same materials as those enumerated above as materials for constituting the external additive having a small particle diameter. Preferred of those finely particulate inorganic materials for use as the external additive having a large particle diameter are titania, zirconia, alumina, silica, strontium titanate, barium titanate, and calcium titanate.

Examples of the fine organic particles according to the external additive having a large particle diameter include resin particles such as styrene resin particles, styrene/acrylic resin particles, polyester resin particles, urethane resin particles, silicone resin particles, and acrylic resin particles. Such resin particles which constitute the fine organic particles are not limited in the composition thereof. However, fine organic particles of vinyl polymers are preferred because these fine organic particles can be easily produced by a production process such as an emulsion polymerization or suspension polymerization method. Preferred of these finely particulate organic materials for use as the external additive having a large particle diameter are acrylic resin particles, styrene/acrylic resin particles, and silicone resin particles.

<Configuration of the Toner>

The components which constitute the toner of the invention include a binder resin and a colorant (pigment) and optionally further include interval additives, e.g., a charge control agent and a wax, external additives, etc.

Examples of the binder resin include polystyrene resins, epoxy resins, polyester resins, polyamide resins, styrene/acrylic resins, styrene/methacrylate resins, polyurethane resins, vinyl resins, polyolefin resins, styrene/butadiene resins, phenolic resins, polyethylene resins, silicone resins, butyral resins, terpene resins, and polyol resins.

As the colorant, known colorants can be used at will. Specific examples of the colorant include known dyes or pigments such as carbon black, aniline blue, phthalocyanine blue, phthalocyanine green, Hansa Yellow, rhodamine dyes or pigments, chrome yellow, quinacridone, benzidine yellow, Rose Bengal, triarylmethane dyes or pigments, and monoazo, disazo, and condensation-azo dyes or pigments. Any desired one of or a mixture of any desired two or more of these dyes and pigments can be used. In the case of full-color toners, it is preferred to use benzidine yellow or a monoazo or condensation-azo dye or pigment as yellow, quinacridone or a monoazo dye or pigment as magenta, and phthalocyanine blue as cyan. It is preferable that the colorant should be used in an amount of 3-20 parts by mass per 100 parts by mass of the primary polymer particles.

A charge control agent may be used in the toner. In the case of using one or more charge control agents, any desired known charge control agents can be used either alone or in combination. For example, examples of positively chargeable charge control agents include quaternary ammonium salts and basic or electron-donating metallic substances, and examples of negatively chargeable charge control agents include metal chelates, metal salts of organic acids, metal-containing dyes, Nigrosine dyes, amide group-containing compounds, phenol compounds, naphthol compounds, metal salts of these compounds, urethane bond-containing compounds, and acidic or electron-attracting organic substances.

In the case where the toner of the invention is for use as a color toner or as any of the full-color toners other than the black toner, it is preferred to use a charge control agent which is colorless or has a light color and which does not arouse a color trouble in the toner. For example, quaternary ammonium salt compounds are preferred as positively chargeable charge control agents, and salts or complexes of either salicylic acid or an alkylsalicylic acid with metals such as chromium, zinc, and aluminum, metal salts or metal complexes of benzilic acid, amide compounds, phenol compounds, naphthol compounds, phenol-amide compounds, and hydroxynaphthalene compounds such as 4,4'-methylenebis[2-[N-(4-chlorophenyl)amido]-3-hydroxynaphthalene] are preferred as negatively chargeable charge control agents.

A wax can be incorporated into the toner of the invention in order to impart release properties. As the wax, use can be made of any wax having release properties. Specific examples thereof include: olefin waxes such as low-molecular-weight polyethylene, low-molecular-weight polypropylene, and polyethylene copolymers; paraffin waxes; ester waxes having a long-chain aliphatic group, such as behenyl behenate, montanic acid esters, and stearyl stearate; vegetable waxes such as hydrogenated castor oil and carnauba wax; ketones having a long-chain alkyl group, such as distearyl ketone; silicones having an alkyl group; higher fatty acids such as stearic acid; long-chain aliphatic alcohols such as eicosanol; carboxylic acid esters or partial esters of polyhydric alcohols, the esters being obtained from polyhydric alcohols such as glycerin and pentaerythritol and long-chain fatty acids; higher fatty acid amides such as oleamide and stearamide; and low-molecular-weight polyesters.

From the standpoint of improving the fixability of the toner, waxes having a melting point of 30° C. or higher are preferred of those waxes, and waxes having a melting point of 40° C. or higher are more preferred. Especially preferred are waxes having a melting point of 50° C. or higher. Meanwhile, waxes having a melting point of 100° C. or lower are preferred, and waxes having a melting point of 90° C. or lower are more preferred. Especially preferred are waxes having a melting point of 80° C. or lower. So long as a wax having a melting point within that range is used, the toner is made to show excellent fixability at low temperatures, without arousing troubles such as tackiness.

With respect to the kinds of wax compounds, waxes based on higher fatty acid esters are preferred. Specifically, preferred examples of the waxes based on higher fatty acid esters are esters of a fatty acid having 15-30 carbon atoms with a mono- to pentahydric alcohol, such as behenyl behenate, stearyl stearate, stearic acid esters of pentaerythritol, and montanic glycerides. With respect to alcohol ingredients for constituting such esters, monohydric alcohols having 10-30 carbon atoms are preferred, and polyhydric alcohols having 3-10 carbon atoms are preferred.

Such waxes may be used alone or as a mixture thereof. The melting point of wax compound can be suitably selected in accordance with the fixing temperature at which the toner is to be fixed. The amount of the wax, per 100 parts by mass of the toner base particles, is preferably 1 part by mass or larger, more preferably 2 parts by mass or larger, even more preferably 5 parts by mass or larger. The amount thereof is preferably 40 parts by mass or less, more preferably 35 parts by mass or less, even more preferably 30 parts by mass or less. Too low contents of the wax in the toner may result in cases where this toner is insufficient in performances such as high-temperature non-offset properties. Too high contents thereof may result in cases where this toner is insufficient in non-blocking properties or where wax leakage from the toner occurs to foul the apparatus.

Examples of the external additives include: inorganic particles such as silica, aluminum oxide (alumina), zinc oxide, tin oxide, barium titanate, and strontium titanate; particles of organic acid salts such as zinc stearate and calcium stearate; and organic resin particles such as methacrylic ester polymer particles, acrylic ester polymer particles, styrene/methacrylic ester copolymer particles, and styrene/acrylic ester copolymer particles.

[Process for Producing the Toner for Electrostatic-Image Development]

Next, a process for producing the toner for electrostatic-image development according to the invention is explained.

[Step for Producing Toner Base Particles]

Processes for producing the toner base particles of the invention are not limited, and use can be made of a pulverization process, wet process, etc. Furthermore, a toner may be rounded by a method utilizing, for example, mechanical impact force or heat treatment. Examples of the wet process include a suspension emulsion method, emulsion polymerization aggregation method, dissolution suspension method, and ester elongation method.

<Pulverization Process>

A method for producing toner base particles by a pulverization process is explained. In the case of a pulverization process, a binder resin and a colorant are weighed out in given amounts optionally together with other ingredients and put together and mixed. Examples of mixing devices include a double-cone mixer, twin-cylinder mixer, drum mixer, supermixer, Henschel mixer, and Nauta mixer.

Next, the raw material for toner obtained by putting together and mixing the ingredients is melt-kneaded to melt the resin(s) and disperse the colorant, etc. therein. In this melt-kneading step, use can be made, for example, of a batch kneading machine or continuous kneading machine, such as a pressure kneader or a Banbury mixer. Such kneading machines to be used may be single-screw or twin-screw extruders, and examples thereof include twin-screw extruder Type KTK, manufactured by Kobe Steel, Ltd., twin-screw extruder Type TEM, manufactured by Toshiba Machine Co., Ltd., a twin-screw extruder manufactured by KCK Co., Ltd., and a co-kneader manufactured by Buss AG. Furthermore, after the melt kneading, the colored resin composition obtained by melt-kneading the raw material for toner is rolled with a twin-roll mill or the like and cooled by a cooling step in which the rolled composition is cooled by water cooling, etc.

The cooled colored resin composition thus obtained is then pulverized in a pulverization step to a desired particle diameter. In the pulverization step, the cooled composition is first crushed with a crusher, hammer mill, feather mill, or the like and is then pulverized with Kryptron System, manufactured by Kawasaki Heavy Industries, Ltd., Super Rotor, manufactured by Nisshin Engineering Co., Ltd., etc. Thereafter, the resultant powder is classified according to need using a sieving machine, e.g., a classifier such as Elbow-Jet (manufactured by Nittetsu Mining Co., Ltd.), which is based on inertial classification, or Turboplex (manufactured by Hosokawa Micron Corp.), which is based on centrifugal classification, thereby obtaining toner base particles. Furthermore, the toner base particles may be rounded using a conventional method.

<Wet Process>

It is preferable in the invention that a wet process should be used in which toner base particles are produced in a wet-process medium. Examples of the wet process include a suspension polymerization method, emulsion polymerization aggregation method, and dissolution suspension method. Toner base particles may be produced by any of these methods without particular limitations. However, it is preferable that the toner base particles should be ones produced by an emulsion polymerization aggregation method.

(Suspension Polymerization Method)

In the suspension polymerization method, a colorant and a polymerization initiation are added to one or more monomers for a binder resin optionally together with additives such as a wax, polar resin, charge control agent, and crosslinking agent, and the ingredients are evenly dissolved or dispersed to prepare a monomer composition. This monomer composition is dispersed in an aqueous medium which contains a dispersion stabilizer or the like. It is preferred to regulate the stirring speed and time so that the monomer composition is dispersed into droplets which have a desired toner particle size. Thereafter, polymerization is conducted while maintaining the state of the droplets by the action of the dispersion stabilizer and while stirring the suspension to such a degree that the droplets are prevented from sedimenting. The resultant particles are collected through washing/filtration. Thus, toner base particles can be obtained.

(Dissolution Suspension Method)

In the dissolution suspension method, a binder resin is dissolved in an organic solvent, and a colorant and other ingredients are added and dispersed therein. The resultant solution phase is dispersed by means of mechanical shear force in an aqueous phase which contains a dispersant or the like, thereby forming droplets. The organic solvent is removed from the droplets. Thus, toner base particles can be obtained.

(Emulsion Polymerization Aggregation Method)

In the emulsion polymerization aggregation method, primary particles of a polymer of one or more binder-resin monomers are produced beforehand by an emulsion polymerization step, and a dispersion of a colorant, a wax dispersion, etc. are also produced in advance. These ingredients are dispersed in an aqueous medium, and this dispersion is subjected to an aggregation step, in which the dispersion is heated or otherwise treated, and then to a ripening step. The resultant particles are collected through washing/filtration. Thus, toner base particles can be obtained. Subsequently, the toner base particles are subjected to a step for drying. Furthermore, external additives, etc. are added to the toner base particles according to need. Thus, a toner can be obtained.

The emulsion polymerization aggregation method is explained in more detail. In the emulsion polymerization step, one or more polymerizable monomers which becomes a binder resin are polymerized in an aqueous medium usually in the presence of an emulsifying agent. In this case, when the polymerizable monomers are fed to the polymerization system, the monomers may be separately added or may be simultaneously added as a mixture prepared beforehand by mixing the multiple monomers. Furthermore, each monomer may be added as such, or may be added as an emulsion prepared beforehand by mixing the monomer with water and an emulsifying agent, etc.

Examples of the polymerizable monomers include acidic monomers and basic monomers.

Examples of the acidic monomers include polymerizable monomers having a carboxyl group, such as acrylic acid, methacrylic acid, maleic acid, fumaric acid, and cinnamic acid, polymerizable monomers having a sulfo group, such as sulfonated styrene, and polymerizable monomers having a sulfonamide group, such as vinylbenzenesulfonamide.

Examples of the basic monomers include aromatic vinyl compounds having an amino group, such as aminostyrene, polymerizable monomers containing a nitrogenous heterocycle, such as vinylpyridine and vinylpyrrolidone, and (meth) acrylic acid esters having an amino group, such as dimethylaminoethyl acrylate and diethylaminoethyl methacrylate.

These acidic monomers and basic monomers may be used either alone or as a mixture of two or more thereof, and may be present as salts accompanied with counter ions. Preferred of those monomers are acidic monomers. More preferred is acrylic acid and/or methacrylic acid.

It is desirable that the total amount of the acidic monomer (s) and basic monomer(s) in 100 parts by mass of all polymerizable monomers for constituting a binder resin should be preferably 0.05 parts by mass or larger, more preferably 0.5 parts by mass or larger, even more preferably 1.0 part by mass or larger, and be preferably 10 parts by mass or less, more preferably 5 parts by mass or less.

Examples of other polymerizable monomers include styrene compounds such as styrene, methyl styrene, chlorostyrene, dichlorostyrene, p-tert-butylstyrene, p-n-butylstyrene, and p-n-nonylstyrene, acrylic acid esters such as methyl acrylate, ethyl acrylate, propyl acrylate, n-butyl acrylate, isobutyl acrylate, hydroxyethyl acrylate, and 2-ethylhexyl acrylate, methacrylic acid esters such as methyl methacrylate, ethyl methacrylate, propyl methacrylate, n-butyl methacrylate, isobutyl methacrylate, hydroxyethyl methacrylate, and 2-ethylhexyl methacrylate, acrylamide, N-propylacrylamide, N,N-dimethylacrylamide, N,N-dipropylacrylamide, and N,N-dibutylacrylamide. These polymerizable monomers may be used alone or in combination of two or more thereof.

The toner for electrostatic-image development of the invention contains as a binder resin a styrene-based resin which is either a polymer of one or more styrene-compound monomers alone or a polymer of one or more styrene-compound monomers and other monomer(s).

Furthermore, in the case of using a crosslinked resin as a binder resin, a polyfunctional monomer having radical polymerizability is used together with the polymerizable monomers described above. Examples of the polyfunctional monomer include divinylbenzene, hexanediol diacrylate, ethylene glycol dimethacrylate, diethylene glycol dimethacrylate, diethylene glycol diacrylate, triethylene glycol diacrylate, neopentyl glycol dimethacrylate, neopentyl glycol diacrylate, and diallyl phthalate.

It is also possible to use a polymerizable monomer having a reactive group as a pendant group, such as, for example, glycidyl methacrylate, methylolacrylamide, or acrolein. Preferred of these are bifunctional polymerizable monomers having radical polymerizability. Especially preferred are divinylbenzene and hexanediol diacrylate. Those polyfunctional polymerizable monomers may be used alone or as a mixture of two or more thereof.

In the case of producing a binder resin by polymerization by emulsion polymerization, known surfactants can be used as an emulsifying agent. As the surfactant(s), use can be made of either one surfactant selected from cationic surfactants, anionic surfactants, and nonionic surfactants or a combination of two or more surfactants selected from these.

Examples of the cationic surfactants include dodecylammonium chloride, dodecylammonium bromide, dodecyltrimethylammonium bromide, dodecylpyridinium chloride, dodecylpyridinium bromide, and hexadecyltrimethylammonium bromide.

Examples of the anionic surfactants include fatty acid soaps such as sodium stearate and sodium dodecanoate, sodium dodecyl sulfate, sodium dodecylbenzenesulfonate, and sodium lauryl sulfate.

Examples of the nonionic surfactants include polyoxyethylene dodecyl ether, polyoxyethylene monohexadecyl ether, polyoxyethylene nonylphenyl ether, polyoxyethylene lauryl ether, polyoxyethylene sorbitan monooleate ether, and monodecanoylsucrose.

The amount of the emulsifying agent to be used is preferably 0.1-10 parts by mass per 100 parts by mass of the polymerizable monomers. One or more members selected from poly(vinyl alcohol) compounds such as, for example, partly or completely saponified poly(vinyl alcohol), cellulose derivatives including hydroxyethyl cellulose, and the like can be used as a protective colloid in combination with those emulsifying agents.

The volume-average particle diameter of the primary particles of a polymer obtained by the emulsion polymerization is preferably 0.02 μm or larger, more preferably 0.05 μm or larger, even more preferably 0.1 μm or larger, and is preferably 3 μm or less, more preferably 2 μm or less, even more preferably 1 μm or less. Too small particle diameters thereof may result in cases where in the aggregation step, it is difficult to control the rate of aggregation. Too large particle diameters thereof may result in cases where the toner particles to be obtained therefrom through aggregation have too large a particle diameter, making it difficult to obtain a toner having a desired particle diameter.

In the emulsion polymerization suspension method, known polymerization initiators can be used according to need, and one polymerization initiator or a combination of two or more polymerization initiators can be used. For example, use may be made of: a persulfate initiator such as potassium persulfate, sodium persulfate, or ammonium persulfate; a redox initiator in which the persulfate initiator is used as one component in combination with a reducing agent, e.g., acid sodium sulfate; a water-soluble polymerization initiator such as hydrogen peroxide, 4,4'-azobiscyanovaleric acid, t-butyl hydroperoxide, or cumene hydroperoxide; a redox initiator in which the water-soluble polymerization initiator is used as one component in combination with a reducing agent, e.g., a ferrous salt; benzoyl peroxide; or 2,2'-azobisisobutyronitrile. These polymerization initiators may be added to the polymerization system at any time which is before, during, or after addition of the monomers, and these addition methods may be used in combination according to need.

According to need, a known chain transfer agent can be used. Specific examples thereof include t-dodecyl mercaptan, 2-mercaptoethanol, diisopropylxanthogene, carbon tetrachloride, and trichlorobromomethane. Such chain transfer agents may be used alone or in combination of two or more thereof, and be used in an amount of 0-5% by mass based on the polymerizable monomers.

Furthermore, a known suspension stabilizer can be used according to need. Specific examples of the suspension stabilizer include calcium phosphate, magnesium phosphate, calcium hydroxide, and magnesium hydroxide. One of these suspension stabilizers may be used alone, or two or more thereof may be used in combination. The suspension stabilizer may be used in an amount of 1-10 parts by mass per 100 parts by mass of the polymerizable monomers.

The polymerization initiator and the suspension stabilizer each may be added to the polymerization system at any time which is before, during, or after addition of the polymerizable monomers, and these addition methods may be used in combination according to need.

A pH regulator, polymerization degree regulator, defoamer, etc. can be suitably added to the reaction system besides the additives shown above.

In the emulsion polymerization aggregation method, a colorant is incorporated usually in the aggregation step. The dispersion of primary polymer particles is mixed with a dispersion of colorant particles to obtain a dispersion mixture. Thereafter, the particles are aggregated to obtain particle aggregates. It is preferable that the colorant should be used in the state of having been dispersed in water in the presence of an emulsifying agent, and the volume-average particle diameter of the colorant particles is preferably 0.01 μm or larger, more preferably 0.05 μm or larger, and is preferably 3 μm or less, more preferably 1 μm or less.

In the case where a charge control agent is incorporated into a toner using the emulsion polymerization aggregation method, the incorporation can be attained, for example, by a method in which the charge control agent is added during the emulsion polymerization together with the polymerizable monomers, etc., a method in which the charge control agent is added in the aggregation step together with the primary polymer particles, colorant, etc., or a method in which the charge control agent is added after the primary polymer particles, colorant, etc. have been aggregated and substantially come to have a desired particle diameter. Preferred of these is a method in which the charge control agent is dispersed in water using a surfactant and is added in the aggregation step as a dispersion having a volume-average particle diameter of 0.01-3 μm.

Although the aggregation step in the emulsion polymerization aggregation method is conducted in a vessel equipped with a stirrer, there are a method in which the system is heated, a method in which an electrolyte is added, and a method in which these two methods are used in combination. In the case where the primary polymer particles are to be aggregated with stirring to obtain particle aggregates having a desired size, the particle diameter of the particle aggregates is governed by a balance between the cohesive force of the particles themselves and the shear force due to stirring. However, the cohesive force can be enhanced by heating or by adding an electrolyte.

In the case where an electrolyte is added for the aggregation, either an organic salt or an inorganic salt can be used as the electrolyte. Specific examples of the electrolyte include NaCl, KCl, LiCl, $Na_2SO_4$, $K_2SO_4$, $Li_2SO_4$, $MgCl_2$, $CaCl_2$, $MgSO_4$, $CaSO_4$, $ZnSO_4$, $Al_2(SO_4)_3$, $Fe_2(SO_4)_3$, $CH_3COONa$, and $C_6H_5SO_3Na$. Preferred of these are the inorganic salts having a polyvalent metal cation having a valence of 2 or higher.

The amount of the electrolyte to be added varies depending on the kind of the electrolyte, the desired particle diameter, etc. However, the amount thereof, per 100 parts by mass of the solid components of the dispersion mixture, is preferably 0.05 parts by mass or larger, more preferably 0.1 part by mass or larger. Meanwhile, the amount thereof is preferably 25 parts by mass or less, more preferably 15 parts by mass or less, especially preferably 10 parts by mass or less. So long as the addition amount thereof is within that range, the aggregation reaction can be caused to proceed speedily and the aggregation reaction is prevented from yielding a fine powder, particles of irregular shapes, etc. Namely, the particle diameter can be relatively easily controlled, and particle aggregates having a desired average particle diameter can be obtained. The aggregation temperature, in the case of conducting aggregation in the presence of an electrolyte added, is preferably 20° C. or higher, more preferably 30° C. or higher, and is preferably 70° C. or lower, more preferably 60° C. or lower.

In the case of conducting aggregation by means of heating alone without using an electrolyte, the aggregation temperature is preferably (Tg-20)° C. or higher, more preferably (Tg-10)° C. or higher, wherein Tg is the glass transition temperature of the primary polymer particles. Meanwhile, the aggregation temperature is preferably Tg or lower, more preferably (Tg-5)° C. or lower. The time period required for the aggregation is optimized in accordance with the shape of the apparatus and the scale of the treatment. However, in order for the particle diameter of the toner to reach a desired particle diameter, it is desirable to hold the system usually for at least 30 minutes at the given temperature. Heating to the given temperature may be conducted at a constant rate or may be conducted in stages.

Resin particles may be adhered or bonded, according to need, to the surface of each particle aggregate obtained through the aggregation treatment, thereby forming particles. There are cases where the charging properties and heat resistance of the toner to be obtained can be improved by adhering or bonding resin particles having regulated properties to the surface of the particle aggregates, and the effects of the invention can be remarkably enhanced by the adhesion or bonding.

In the case where resin particles having a glass transition temperature higher than the glass transition temperature of the primary polymer particles are used as the resin particles, the non-blocking properties can be further improved without impairing fixability; such resin particles hence are preferred. The volume-average particle diameter of these resin particles is preferably 0.02 μm or larger, more preferably 0.05 μm or larger, and is preferably 3 μM or less, more preferably 1.5 μm or less. As the resin particles, use can be made, for example, of resin particles obtained by emulsion-polymerizing one or more monomers which are the same as any of the polymerizable monomers usable for the primary polymer particles described above.

The resin particles are usually used as a dispersion obtained by dispersing the resin particles in water or in a liquid consisting mainly of water, with the aid of a surfactant. In the case of adding a charge control agent after the aggregation treatment, however, it is preferable that the resin particles should be added after the charge control agent is added to a dispersion containing the particle aggregates. It is preferable that in order to enhance the stability of the particle aggregates obtained in the aggregation step, the particles in each aggregate should be fused to one another in a ripening step after the aggregation step.

In the emulsion polymerization aggregation method, the temperature in the ripening step after the aggregation step is preferably not lower than the Tg of the primary polymer particles, more preferably not lower than the temperature higher than the Tg by 5° C., and is preferably not higher than the temperature higher than the Tg by 80° C., more preferably not higher than the temperature higher than the Tg by 50° C. The time period required for the ripening step varies depending on the desired shape of the toner. However, after the temperature has risen to or above the glass transition temperature of the primary polymer particles, the aggregates are held preferably for 0.1-10 hours, more preferably for 1-6 hours.

It is preferable that a surfactant should be added or the pH be heightened, after the aggregation step, preferably before the ripening step or during the ripening step. As the surfactant to be used here, use can be made of one or more emulsifying agents selected from the emulsifying agents usable in the production of the primary polymer particles. However, it is especially preferred to use the same emulsifying agent as that used when the primary polymer particles were produced.

In the case of adding a surfactant, the addition amount thereof is not limited. However, the amount thereof, per 100 parts by mass of the solid components of the dispersion mixture, is preferably 0.1 part by mass or larger, more preferably 1 part by mass or larger, even more preferably 3 parts by mass or larger, and is preferably 20 parts by mass or less, more preferably 15 parts by mass or less, even more preferably 10 parts by mass or less. There are cases where by adding a surfactant or heightening the pH after the aggregation step and before completion of the ripening step, the particle aggregates formed through aggregation in the aggregation step can be inhibited from suffering aggregation therebetween, etc., and the formation of coarse particles after the ripening step can be inhibited.

By the heat treatment in the ripening step, the primary polymer particles in each aggregate are fused together and integrated with one another. As a result, the aggregates each come to have a toner particle shape which is close to sphere. It is thought that the particle aggregates before the ripening step are each an aggregate of primary polymer particles which has been formed by electrostatic or physical aggregation. After the ripening step, however, the primary polymer particles which constitute each particle aggregate have been fused to one another, making it possible to give toner base particles having a shape close to sphere. According to this ripening step, it is possible to obtain toner base particles having any of various shapes in accordance with purposes, such as, for example, the shape of the aggregates of primary polymer particles or a spherical shape resulting from further progress of the fusion, by controlling the temperature, time period, etc. in the ripening step.

[Step for Washing Toner Base Particles]

The toner base particles obtained by a wet process, e.g., the suspension polymerization method, emulsion polymerization aggregation method, or dissolution suspension method, are taken out of the wet-process medium by solid-liquid separation and recovered as particle aggregates. It is preferable that the particle aggregates recovered should thereafter be washed according to need.

As a liquid for the washing, use may be made of water which has a higher purity than the wet-process medium in which the toner base particles was immersed in the final step of the wet process. Alternatively, an aqueous solution of an acid or alkali may be used. As the acid, use can be made of an inorganic acid such as nitric acid, hydrochloric acid, or sulfuric acid or an organic acid such as citric acid. As the alkali, use can be made of a sodium salt (sodium hydroxide, sodium carbonate, etc.), a silicic acid salt (sodium metasilicate, etc.), a phosphoric acid salt, or the like. The washing can be conducted at ordinary temperature or with heating at about 30-70° C.

The suspension stabilizer, emulsifying agent, wet-process medium, remaining unreacted monomers, small-diameter toner particles, etc. are removed from the toner base particles by the washing step. It is preferable that after the washing step, the toner base particles should be obtained in the state of a wet cake by filtration or decantation. This is because the wet-cake state facilitates handling in later steps. The washing step may be repeatedly conducted in multiple times.

[Step for Removing Water from the Toner Base Particles]

It is preferable that this process for producing the toner for electrostatic-image development of the invention should include a step for removing water from the toner base particles to a water content of 0.4% by mass or less, before the drying step which will be described later. Since the toner base particles in a wet-cake state which have been recovered after the washing step are in a wet state, the content of water in the toner base particles may be 50% by mass or less, more preferably 40% by mass or less, even more preferably 30% by mass or less, based on the amount of the toner base particles which is taken as 100% by mass. The water in the wet-state toner base particles is vaporized in advance until the water content thereof decreases to 0.4% by mass or less. As a result, the volatile organic compounds contained in the toner base particles can be efficiently dissipated in the later drying step.

As a dryer for the water removal step, use can be made of a fluidization dryer, jet dryer, vacuum dryer, or the like. It is preferable that a fluidization dryer in which the material is dried while introducing a gas should be used in order that the latent heat of vaporization of the water be directly given to the toner-base particles to heighten the rate of water removal. For example, the fluidization dryer equipped with a vibrator which will be described later can be used, or a fluidization dryer equipped with no vibrator can be used. It is more preferred to use a fluidization dryer equipped with no vibrator. With respect to the gas to be applied to the fluidization dryer to be used in the water removal step and the temperature of the gas, temperature in the dryer, etc., use can be made of the same gas and the same conditions as the gas to be applied to the fluidization dryer equipped with a vibrator to be used in the drying step which will be described below and the temperature of the gas, temperature in the dryer, etc.

[Step for Drying the Toner Base Particles]

In the step for drying the toner base particles, a dryer such as a fluidization dryer, jet dryer, or vacuum dryer can be used. It is preferable that a fluidization dryer equipped with a vibrator should be used, among those dryers, to dry the toner base particles. In the fluidization dryer equipped with a vibrator, a gas is introduced into the main body of the dryer and the toner base particles can be thereby dried rapidly while utilizing the latent heat of vaporization of the water contained in the toner base particles. Furthermore, by vibrating the toner base particles by means of the vibrator, not only the toner base particles can be fluidized even with a reduced gas flow rate but also the agglomerates which have accumulated in the lower part can be disaggregated to enable the toner base particles to be rapidly and efficiently dried.

It is preferred to conduct the drying at ordinary pressure or a reduced pressure. It is more preferred to conduct the drying at ordinary pressure because at a reduced pressure, the quantity of heat which the gas can give to the toner base particles is small.

[Toner Formation Step]

Next, external additives are added to the toner base particles, and the external additives are adhered or bonded to the surface of the toner base particles, thereby forming a toner. By adding external additives, improvements in OPC (organic photoconductors) filming and transfer efficiency can be attained.

As a method for adding external additives to the toner base particles, use may be made of a technique in which the external additives are added to a system in which the toner base particles have been introduced, and the ingredients are mixed together by stirring. For the mixing and stirring of the toner base particles and the external additives, it is preferred to use a device for mechanical rotation treatment. Specifically, a rotary mixer such as a Henschel mixer is suitable.

It is preferable that the addition treatment with such a device should be conducted at such a stirring speed that the speed of the tips (peripheral speed) of the stirring blades is 21.2-95.5 m/sec, preferably 38.2-76.4 m/sec. By regulating the rotation speed, the degree of burying of the external additives into the colored particles in this stirring/mixing treatment can be regulated. As a result, the flowability of the toner to be obtained can be controlled.

It is preferable that the toner of the invention should have a configuration in which external additives are evenly adherent to the surface of the toner particles. In the case where multiple kinds of particles differing in particle diameter (hereinafter referred to also as "particles with multiple diameters") are used in combination as external additives, these external additives can be evenly adhered to the surface of the toner particles by mixing each external additive in two or more stages. It is preferred to use a technique of multi-stage mixing in which an external additive having a small particle diameter is added and mixed and, thereafter, an external additive having a large particle diameter is added and mixed.

The stirring period in the stirring/mixing treatment can be determined in accordance with the stirring speed, etc.

The temperature at which the external additives are added is preferably 25-55° C., more preferably 30-50° C.

[Properties of the Toner]

The toner produced by the process of the invention has an average degree of circularity which is preferably 0.955 or higher, more preferably 0.960 or higher, and is preferably 0.985 or less, more preferably 0.980 or less. So long as the average degree of circularity of the toner is within that range, satisfactory images can be formed.

[Toner Cartridge]

Another embodiment of the present invention is a toner cartridge equipped with a developing roller for supporting a toner for electrostatic-image development thereon, a charging blade (charging member) disposed on the upper side of the developing roller, a retaining blade disposed on the lower side of the developing roller so as to face the developing roller and be apart therefrom at a necessary distance, and the toner for electrostatic-image development described above.

According to the toner cartridge of the invention, since the toner for electrostatic-image development of the invention is used, not only the toner has a regulated average transporting property so that the flowability and transportability thereof are satisfactory but also the product of the BET specific surface area and average particle diameter of the toner has been regulated so that the state of external addition to the toner is suitable. Due to this, toner leakage can be prevented and the falling of toner masses from the toner cartridge can be eliminated.

The retaining blade is not particularly limited, and use can be made of a film of a polyester, polyether, polyurethane, poly(phenylene sulfide), polyimide, polyethylene, polycarbonate, polypropylene, or the like.

EXAMPLES

The invention will be explained below in more detail by reference to Examples, but the invention should not be construed as being limited to the following Examples unless the invention departs from the spirit thereof. Hereinafter, "parts" means "parts by mass". Actual printing tests will be described later with regard to printing characteristics.

Methods for determining properties, shape, etc. and definitions of these in this description are shown below.

<Method for Determining Volume-Average Diameter (Mv)>

The volume-average diameter (Mv) of particles having a volume-average diameter (Mv) less than 1 μm was determined with Type: Microtrac Nanotrac 150 (hereinafter abbreviated to "Nanotrac"), manufactured by Nikkiso Co., Ltd., in accordance with the instruction manual for Nanotrac using analysis software Microtrac Particle Analyzer Ver 10.1.2.-019EE, provided by the same company. The refractive index of the medium and the measuring time were 1.333 and 100 seconds, respectively, and the measurement was made once. With respect to wax dispersions and dispersions of primary polymer particles, the measurement was made under the conditions of refractive index of the particles, 1.59; transparency, transparent; shape, completely spherical; and density, 1.04. With respect to colorant dispersions, the measurement was made under the conditions of: transparency, absorptive; shape, non-spherical; and density, 1.0.

<Method for Determining Volume-Based Median Diameter (Dv50)>

The volume-based median diameter (Dv50) of particles having a volume-based median diameter (Dv50) of 1 μm or larger was determined with Multisizer III (aperture diameter, 100 μm) (hereinafter abbreviated to "Multisizer"), manufactured by Beckman Coulter, Inc., using Isoton II, manufactured by the same company, as a dispersion medium so that the particles were dispersed therein in a dispersed-phase concentration of 0.03% by mass. The range over which particle diameters were measured was from 2.00 μm to 64.00 μm, and this range was separated into 256 sections at equal intervals on the logarithmic scale. The volume-based median diameter (Dv50) was calculated from volume-based statistical values for those sections.

<Method for Determining Solid Concentration>

The solid concentration of a dispersion of primary polymer particles was determined using solid concentration analyzer INFRARED MOISTURE DETERMINATION BALANCE Type FD-100, manufactured by Kett Electric Laboratory. A 1.00-g portion of the solid-containing sample was precisely weighed out and placed on the balance, and a measurement was made under the conditions of a heater temperature of 300° C. and a heating period of 90 minutes.

<Method for Determining Average Degree of Circularity>

The "average degree of circularity" in the invention is determined and defined as shown below. Toner base particles are dispersed in a dispersion medium (Isoton II, manufactured by Beckman Coulter, Inc.) so as to result in a concentration in the range of 5,720-7,140 particles per μL. Using a flow type particle image analyzer (FPIA2100, manufactured by Sysmex Corp. (former name, To a Medical Electronics Inc.)), a measurement was made under the following apparatus conditions. The value thus obtained is defined as "average degree of circularity". In the invention, the same measurement was conducted three times, and the arithmetic mean of the three values of "average degree of circularity" is adopted as the "average degree of circularity".

Mode: HPF

HPF analysis amount: 0.35 μL

Number of particles detected by HPF: 2,000-2,500

The following are properties determined by the apparatus and displayed thereon through automatic calculations made therein. The "degree of circularity" is defined by the following equation.

[Degree of circularity]=[circumference of circle having the same area as projected particle area]/[circumference of the projected particle image]

After 2,000-2,500 particles, as shown above as the number of particles detected by HPF, are examined, the arithmetic mean of the degrees of circularity of the individual particles is displayed as "average degree of circularity" on the apparatus.

<Method for Determining BET Specific Surface Area of External Additive and Toner>

Using Macsorb model-1201, manufactured by Mountech Co., Ltd., a measurement was made by the one-point method using liquid nitrogen. Specifically, the procedure is as follows.

First, about 1.0 g of a test sample was packed into a special cell made of glass (hereinafter this amount of the sample packed is expressed by A (g)). Subsequently, the cell was set in the main body of the measuring apparatus, and drying and degassing (for examination of external additive, 200° C. and 20 minutes; for examination of toner, 40° C. and 20 minutes) were conducted in a nitrogen atmosphere. The cell was then cooled to room temperature. Thereafter, a measuring gas (mixed gas composed of 30% first-grade nitrogen and 70% helium) was passed through the inside of the cell at a flow rate of 25 mL/min, while the cell was being cooled with liquid nitrogen, and the amount of the measuring gas V ($cm^3$) adsorbed onto the sample was determined. When the total surface area of the sample is expressed by S ($m^2$), the BET specific surface area ($m^2/g$) to be determined can be calculated using the following calculation formula.

$$(\text{BET specific surface area}) = S/A$$

$$= [K \cdot (1 - P/P_0) \cdot V]/A$$

K: gas constant (4.29 in this measurement)

$P/P_0$: relative pressure of the adsorbate gas; 97% of the proportion (0.29 in this measurement)

<Method for Determining Average Particle Diameter of External Additive>

The term "average particle diameter of an external additive" means the number-average particle diameter. The particle diameter (average of major-axis length and minor-axis length) of each of 500 particles was determined from a scanning electron microscope (SEM) photograph, and the average of these values is taken as the average particle diameter.

<Method for Determining Loosened Apparent Density>

In an atmosphere having a temperature of 23±1° C. and a humidity of 50±3%, 15.0 g of a toner to be examined was placed in a 50-mL measuring cylinder, which was lidded. This measuring cylinder was gently shaken 20 times to vertically stir the toner. The measuring cylinder was placed on a stable place and allowed to stand still after the lid was removed. At the time when 10 minutes had passed since then, the value of volume was read and the loosened apparent density [$g/cm^3$] was calculated therefrom.

<Method for Determining Average Transporting Property>

An oscillation transportation type flowability tester manufactured by Etowas Co., Ltd. was used.

In an atmosphere having a temperature of 23±1° C. and a humidity of 50±3%, 1.0 g of a toner to be examined was set in the apparatus. The driving device was operated under the conditions of a voltage of 80 V and a frequency of 135 Hz to transport the toner into the receiving pan. The amount of the toner thus transported was measured. The time periods from the start of the driving device to the time when the amount of the transported toner reached 300 mg and to the time when the amount thereof reached 750 mg were measured, and the transportability was calculated using the following equation.

(Average transporting property)=[(750−300) mg]/[(T750−T300) sec]

In the general formula, T300 indicates the time period required for transporting 300 mg of the toner to the receiving pan, and T750 indicates the time period required for transporting 750 mg of the toner to the receiving pan.

<Image Defect>

A toner obtained was used to conduct printing, and the prints were evaluated for image defects through a visual examination. The results thereof are shown in Table 2 and Table 4. In the tables, ○ indicates that "there is no problem", Δ indicates that "the prints have no practical problem but unevenness in image density is noticed on close inspection", and x indicates that "troubles such as following-up failures and image blurring are observed".

<<With Respect to Toner Base Particles A>>

<Preparation of Colorant Dispersion>

Into the vessel of a stirrer equipped with propeller blades were introduced 24 parts of a cyan pigment (Pigment Blue 15:3), 4.8 parts of a nonionic surfactant (Emulgen 120, manufactured by Kao Corp. (polyoxyethylene lauryl ether having an HLB of 15.3 and a cloud point of 98° C.)) (20 parts based on the pigment), and 100 parts of ion-exchanged water having an electrical conductivity of 2 μS/cm. The ingredients were preliminarily dispersed to obtain a pigment premix liquid.

The premix liquid was fed as a raw slurry to a wet-process bead mill equipped with a rotary screen (mesh separator for bead separation) and subjected to a circulating dispersion treatment. The stator had an inner diameter of 120 mm, and the separator had a diameter of 60 mm. As a dispersing medium, zirconia beads (true density, 6.0 $g/cm^3$) having a diameter of 100 μm (0.1 mm) were used. The stator had an effective capacity of about 0.5 L, and the medium was packed thereinto so as to occupy a volume of 0.35 L. Consequently, the degree of packing of the medium was 70%.

The rotation speed of the rotor was kept constant (peripheral speed of the tip of the rotor, about 7 m/sec), and the premix slurry was fed through the feed port with a non-pulsating constant delivery pump at a feed rate of about 54 L/hr. During the operation, cooling water having a temperature of about 10° C. was kept being circulated through the jacket. Thus, a blue "colorant dispersion" having a volume-based median diameter of 0.13 μm and a viscosity of 50 cP was obtained.

<Preparation of Wax Dispersion A1>

To 27.3 parts of HNP9 (manufactured by Nippon Seiro Co., Ltd.; melting point, 74° C.) as wax 1 were added 2.7 parts of stearyl acrylate, 2.8 parts of 20% aqueous sodium dodecylbenzenesulfonate solution (Neogen S20D, manufactured by Dai-ichi Kogyo Seiyaku Co., Ltd; hereinafter abbreviated to 20% aqueous DBS solution), and 67.3 parts of desalted water. The mixture was heated to 100° C. and subjected to primary circulating emulsification at an elevated pressure of 10 MPa using a homogenizer equipped with a pressurized circulation line (LAB60 Type 10TBS, manufactured by Gaulin Company). The dispersion was examined for particle diameter with LA950 at intervals of several minutes, and at the time when the median diameter thereof had decreased to about 500 nm, the pressure was elevated to 25 MPa. Secondary circulating emulsification was successively conducted. The dispersion treatment was continued until the median diameter decreased to 230 nm or less. Thus, wax dispersion A1 was produced. The final median diameter thereof was 227 nm.

<Preparation of Primary-Polymer-Particle Dispersion B1>

Into a reactor were introduced 36.0 parts of the wax dispersion A1 and 255 parts of desalted water, the reactor being equipped with a stirrer (three blades), heating/cooling device, condenser, and device for introducing starting materials and aids. While being stirred, the contents were heated to 90° C. in a nitrogen stream.

Thereafter, while the liquid was being stirred, a mixture of the following "polymerizable monomers, etc." and "aqueous emulsifying agent solution" was added thereto over 5 hours. The time at which the dropwise addition of the mixture was initiated was taken as "polymerization initiation". The following "aqueous initiator solution" was added over 4.5 hours from the time when 30 minutes had passed since the polymerization initiation. Furthermore, the following "additional aqueous initiator solution" was added over 2 hours from the time when 5 hours had passed since the polymerization initiation. Thereafter, the mixture was kept being stirred for 1 hour while maintaining the internal temperature of 90° C.

[Polymerizable Monomers, Etc.]

| | |
|---|---|
| Styrene | 76.8 parts |
| Butyl acrylate | 23.2 parts |
| Acrylic acid | 0.85 parts |
| Hexanediol diacrylate | 0.7 parts |
| Trichlorobromomethane | 0.64 parts |

[Aqueous Emulsifying Agent Solution]

| | |
|---|---|
| 20% aqueous DBS solution | 0.8 parts |
| Desalted water | 66.9 parts |

[Aqueous Initiator Solution]

| | |
|---|---|
| 8% by mass aqueous hydrogen peroxide solution | 15.5 parts |
| 8% by mass aqueous L(+)-ascorbic acid solution | 15.5 parts |

[Additional Aqueous Initiator Solution]

| | |
|---|---|
| 8% by mass aqueous L(+)-ascorbic acid solution | 14.2 parts |

After completion of the polymerization reaction, the reaction mixture was cooled to obtain primary-polymer-particle dispersion B1, which was milk-white. This dispersion had a volume-average diameter (Mv), as determined with Nanotrac, of 275 nm and had a solid concentration of 22.6% by mass.

<Preparation of Primary-Polymer-Particle Dispersion B2>

Into a reactor were introduced 2.0 parts of 20% aqueous DBS solution and 355 parts of desalted water, the reactor being equipped with a stirrer (three blades), heating/cooling device, condenser, and device for introducing starting materials and aids. While being stirred, the contents were heated to 90° C. in a nitrogen stream. At the time when 90° C. had been reached, the following "aqueous initiator solution for prior introduction" was added.

Thereafter, while the liquid was being stirred, a mixture of the following "polymerizable monomers, etc." and "aqueous emulsifying agent solution" was added thereto over 5 hours. The time at which the dropwise addition of the mixture was initiated was taken as "polymerization initiation". The following "aqueous initiator solution" was added over 6.0 hours from immediately after the polymerization initiation. Thereafter, the mixture was kept being stirred for 1 hour while maintaining the internal temperature of 90° C.

[Polymerizable Monomers, Etc.]

| | |
|---|---|
| Styrene | 100.0 parts |
| Acrylic acid | 0.5 parts |
| Trichlorobromomethane | 0.5 parts |

[Aqueous Emulsifying Agent Solution]

| | |
|---|---|
| 20% aqueous DBS solution | 1.0 part |
| Desalted water | 42.1 part |

[Aqueous Initiator Solution for Prior Introduction]

| | |
|---|---|
| 8% by mass aqueous hydrogen peroxide solution | 3.2 parts |
| 8% by mass aqueous L(+)-ascorbic acid solution | 3.2 parts |

[Aqueous Initiator Solution]

| | |
|---|---|
| 8% by mass aqueous hydrogen peroxide solution | 18.9 parts |
| 8% by mass aqueous L(+)-ascorbic acid solution | 18.9 parts |

After completion of the polymerization reaction, the reaction mixture was cooled to obtain primary-polymer-particle dispersion B2, which was milk-white. This dispersion had a volume-average diameter (Mv), as determined with Nanotrac, of 156 nm and had a solid concentration of 19.6% by mass.

<Production of Toner Base Particles A>

The ingredients shown below were used to conduct the following aggregation step (core material aggregation step/shell formation step) and rounding step, thereby producing toner base particles A.

| | |
|---|---|
| Primary-polymer-particle dispersion B1 | 90 parts in terms of solid amount (dispersion B1, 318.1 kg/solid amount, 71.2 kg; for cores) |
| Primary-polymer-particle dispersion B2 | 10 parts in terms of solid amount (dispersion B2, 40.4 kg/solid amount, 7.9 kg; for shells) |
| Dispersion of fine particles of colorant | 4.9 parts in terms of solid colorant amount |
| 20% aqueous DBS solution | 6 parts in terms of solid amount, in the rounding step |

(Core Material Aggregation Step)

Primary-polymer-particle dispersion B1 was introduced into a mixing vessel (capacity, 1,000 L; inner diameter, 850 mm) equipped with a stirrer (double helical blade), heating/cooling device, and device for introducing starting materials and aids. Thereto was added 0.1 part of 20% aqueous DBS solution. The contents were evenly mixed for 10 minutes at an internal temperature of 10° C. Subsequently, while stirring the contents at 101 rpm and an internal temperature of 10° C., a 5% by mass aqueous solution of iron sulfate was continuously added thereto over 1 minute in an amount of 0.12 parts in terms of $FeSO_4$ amount and, thereafter, the dispersion of fine particles of a colorant was continuously added thereto over 5 minutes. The ingredients were evenly mixed together at an internal temperature of 10° C.

Thereafter, a 0.5% by mass aqueous solution of aluminum sulfate was continuously added thereto over 30 minutes in an amount of 0.1 part in terms of solid amount, and the internal temperature was then elevated to 50.5° C. over 113 minutes while maintaining the rotation speed of 101 rpm. Subsequently, the temperature was elevated by 1° C. at intervals of 30 minutes (0.03° C./min) and kept at 54.5° C. to allow the particles to grow to 6.58 μm while determining the volume-based median diameter with Multisizer.

(Shell Formation Step)

Thereafter, while maintaining the internal temperature of 54.5° C. and the rotation speed of 101 rpm, primary-polymer-particle dispersion B2 was continuously added thereto over 15 minutes, and the resultant mixture was held for 60 minutes under those conditions. The resultant particles had a Dv50 of 6.91 μm.

(Rounding Step)

Subsequently, while maintaining the rotation speed, an aqueous solution obtained by mixing 20% aqueous DBS solution (6 parts in terms of solid amount) with 0.04 parts of water was added thereto over 30 minutes, during which the internal temperature was elevated to 90° C. Thereafter, the internal temperature was elevated by 2° C. at intervals of 30 minutes to 97° C., and the resultant mixture was continuously heated and stirred under those conditions over further 2.5 hours until the average degree of circularity thereof became 0.966. The resultant mixture was then cooled to 20° C. over 50 minutes to obtain a slurry of toner base particles A. The particles of this slurry had a volume-based median diameter of 6.85 μm, a number-based median diameter of 6.40 μm, a distribution, (volume-based median diameter)/(number-based median diameter), of 1.071, and an average degree of circularity of 0.968.

(Washing/Drying Step)

The whole slurry obtained was subjected to a filtration treatment with a wet-process electromagnetic sieve shaking machine (AS200; Retsch Co., Ltd.) equipped with a sieve having an opening size of 24 μm, for the purpose of removing coarse particles. The treated slurry was temporarily placed in a tank equipped with a stirrer. Thereafter, this slurry was supplied to a horizontal centrifugal separator (Type HZ40Si; Mitsubishi Kakoki Kaisha, Ltd.) in which a filter cloth (polyester TR815c; Nakao Filter Media Corp.; thickness, 0.3 mm; air permeability, 48 (cc/cm$^2$/min)) had been mounted, and centrifugal dehydration washing was conducted under the conditions of an acceleration of 800 G. Ion-exchanged water having an electrical conductivity of 1 μS/cm was added thereto in an amount about 50 times the amount of the solid components of the slurry at such a rate that the water did not overflow the rim. As a result, the electrical conductivity of the filtrate became 2 μS/cm. Finally, the water was sufficiently removed by centrifuging, and the cake was recovered with a scraper.

The cake thus obtained was spread in a stainless-steel vat in a thickness of 20 mm and dried for 48 hours in an air-blowing drying oven set at 40° C. Thus, toner base particles A were obtained.

<<With Respect to Toner Base Particles B>>

<Preparation of Colorant Dispersion>

Into the vessel of a stirrer equipped with propeller blades were introduced 20 parts of a carmine magenta pigment (Pigment Red 269), 4.0 parts of a nonionic surfactant (Emulgen 120, manufactured by Kao Corp. (polyoxyethylene lauryl ether having an HLB of 15.3 and a cloud point of 98° C.)) (20 parts based on the pigment), and 100 parts of ion-exchanged water having an electrical conductivity of 2 μS/cm. The ingredients were preliminarily dispersed to obtain a pigment premix liquid. The premix liquid was fed as a raw slurry to a wet-process bead mill equipped with a rotary screen (mesh separator for bead separation) and subjected to a circulating dispersion treatment. The stator had an inner diameter of 120 mm, and the separator had a diameter of 60 mm. As a dispersing medium, zirconia beads (true density, 6.0 g/cm$^3$) having a diameter of 100 μm (0.1 mm) were used. The stator had an effective capacity of about 0.5 L, and the medium was packed thereinto so as to occupy a volume of 0.35 L. Consequently, the degree of packing of the medium was 70%.

The rotation speed of the rotor was kept constant (peripheral speed of the tip of the rotor, about 7 m/sec), and the premix slurry was fed through the feed port with a non-pulsating constant delivery pump at a feed rate of about 54 L/hr. During the operation, cooling water having a temperature of about 10° C. was kept being circulated through the jacket. Thus, a "colorant dispersion" of a magenta color having a volume-based median diameter of 0.12 μm and a viscosity of 70 cP was obtained.

<Preparation of Wax Dispersion AA1>

To 27.3 parts of HNP9 (manufactured by Nippon Seiro Co., Ltd.; melting point, 74° C.) as wax 1 were added 2.7 parts of stearyl acrylate, 2.8 parts of 20% aqueous sodium dodecylbenzenesulfonate solution (Neogen S20D, manufactured by Dai-ichi Kogyo Seiyaku Co., Ltd; hereinafter abbreviated to 20% aqueous DBS solution), and 67.3 parts of desalted water. The mixture was heated to 100° C. and subjected to primary circulating emulsification at an elevated pressure of 10 MPa using a homogenizer equipped with a pressurized circulation line (LAB60 Type 10TBS, manufactured by Gaulin Company). The dispersion was examined for particle diameter with LA950 at intervals of several minutes, and at the time when the median diameter thereof had decreased to about 500 nm, the pressure was elevated to 25 MPa. Secondary circulating emulsification was successively conducted. The dispersion treatment was continued until the median diameter decreased to 230 nm or less. Thus, wax dispersion AA1 was produced. The final median diameter thereof was 227 nm.

<Preparation of Primary-Polymer-Particle Dispersion BB1>

Into a reactor were introduced 36.0 parts of the wax dispersion AA1 and 255 parts of desalted water, the reactor being equipped with a stirrer (three blades), heating/cooling device, condenser, and device for introducing starting materials and aids. While being stirred, the contents were heated to 90° C. in a nitrogen stream.

Thereafter, while the liquid was being stirred, a mixture of the following "polymerizable monomers, etc." and "aqueous emulsifying agent solution" was added thereto over 5 hours. The time at which the dropwise addition of the mixture was initiated was taken as "polymerization initiation". The following "aqueous initiator solution" was added over 4.5 hours from the time when 30 minutes had passed since the polymerization initiation. Furthermore, the following "additional aqueous initiator solution" was added over 2 hours from the time when 5 hours had passed since the polymerization initiation. Thereafter, the mixture was kept being stirred for 1 hour while maintaining the internal temperature of 90° C.

[Polymerizable Monomers, Etc.]

| | |
|---|---|
| Styrene | 76.8 parts |
| Butyl acrylate | 23.2 parts |
| Acrylic acid | 1.5 parts |
| Hexanediol diacrylate | 0.7 parts |
| Trichlorobromomethane | 1.0 part |

[Aqueous Emulsifying Agent Solution]

| | |
|---|---|
| 20% aqueous DBS solution | 1.0 part |
| Desalted water | 67.1 part |

[Aqueous Initiator Solution]

| | |
|---|---|
| 8% by mass aqueous hydrogen peroxide solution | 15.5 parts |
| 8% by mass aqueous L(+)-ascorbic acid solution | 15.5 parts |

[Additional Aqueous Initiator Solution]

| | |
|---|---|
| 8% by mass aqueous L(+)-ascorbic acid solution | 14.2 parts |

After completion of the polymerization reaction, the reaction mixture was cooled to obtain primary-polymer-particle dispersion BB1, which was milk-white. This dispersion had a volume-average diameter (Mv), as determined with Nanotrac, of 275 nm and had a solid concentration of 22.6% by mass.

<Preparation of Primary-Polymer-Particle Dispersion BB2>

Into a reactor were introduced 2.0 parts of 20% aqueous DBS solution and 355 parts of desalted water, the reactor being equipped with a stirrer (three blades), heating/cooling device, condenser, and device for introducing starting materials and aids. While being stirred, the contents were heated to 90° C. in a nitrogen stream. At the time when 90° C. had been reached, the following "aqueous initiator solution for prior introduction" was added.

Thereafter, while the liquid was being stirred, a mixture of the following "polymerizable monomers, etc." and "aqueous emulsifying agent solution" was added thereto over 5 hours. The time at which the dropwise addition of the mixture was initiated was taken as "polymerization initiation". The following "aqueous initiator solution" was added over 6.0 hours from immediately after the polymerization initiation. Thereafter, the mixture was kept being stirred for 1 hour while maintaining the internal temperature of 90° C.

[Polymerizable Monomers, Etc.]

| | |
|---|---|
| Styrene | 100.0 parts |
| Acrylic acid | 0.5 parts |
| Trichlorobromomethane | 0.5 parts |

[Aqueous Emulsifying Agent Solution]

| | |
|---|---|
| 20% aqueous DBS solution | 1.0 part |
| Desalted water | 42.1 part |

[Aqueous Initiator Solution for Prior Introduction]

| | |
|---|---|
| 8% by mass aqueous hydrogen peroxide solution | 3.2 parts |
| 8% by mass aqueous L(+)-ascorbic acid solution | 3.2 parts |

[Aqueous Initiator Solution]

| | |
|---|---|
| 8% by mass aqueous hydrogen peroxide solution | 18.9 parts |
| 8% by mass aqueous L(+)-ascorbic acid solution | 18.9 parts |

After completion of the polymerization reaction, the reaction mixture was cooled to obtain primary-polymer-particle dispersion BB2, which was milk-white. This dispersion had a volume-average diameter (Mv), as determined with Nanotrac, of 156 nm and had a solid concentration of 19.6% by mass.

<Production of Toner Base Particles B>

The ingredients shown below were used to conduct the following aggregation step (core material aggregation step/shell formation step) and rounding step, thereby producing toner base particles B.

| | |
|---|---|
| Primary-polymer-particle dispersion BB1 | 90 parts in terms of solid amount (dispersion BB1, 318.1 kg/solid amount, 71.2 kg; for cores) |
| Primary-polymer-particle dispersion BB2 | 10 parts in terms of solid amount (dispersion BB2, 40.4 kg/solid amount, 7.9 kg; for shells) |
| Dispersion of fine particles of colorant | 5.0 parts in terms of solid colorant amount |
| 20% aqueous DBS solution | 6 parts in terms of solid amount, in the rounding step |

(Core Material Aggregation Step)

Primary-polymer-particle dispersion BB1 was introduced into a mixing vessel (capacity, 1,000 L; inner diameter, 850 mm) equipped with a stirrer (double helical blade), heating/cooling device, and device for introducing starting materials and aids. Thereto was added 0.05 parts of 20% aqueous DBS solution. The contents were evenly mixed for 10 minutes at an internal temperature of 10° C. Subsequently, while stirring the contents at 101 rpm and an internal temperature of 10° C., a 5% by mass aqueous solution of potassium sulfate was continuously added thereto over 1 minute in an amount of 0.12 parts in terms of $K_2SO_4$ amount and, thereafter, the dispersion of fine particles of a colorant was continuously added thereto over 5 minutes. The ingredients were evenly mixed together at an internal temperature of 10° C.

Thereafter, a 0.5% by mass aqueous solution of aluminum sulfate was continuously added thereto over 30 minutes in an amount of 0.2 parts in terms of solid amount, and 0.2 parts of desalted water was further added over 30 minutes. The internal temperature was then elevated to 54.0° C. over 90 minutes while maintaining the rotation speed of 101 rpm. Subsequently, the temperature was elevated by 1.0° C. after 30 minutes and kept at 55.0° C. to allow the particles to grow to 6.00 μm while determining the volume-based median diameter with Multisizer.

(Shell Formation Step)

Thereafter, while maintaining the internal temperature of 55.0° C. and the rotation speed of 101 rpm, primary-polymer-particle dispersion BB2 was continuously added thereto over 15 minutes, and the resultant mixture was held for 60 minutes under those conditions. The resultant particles had a Dv50 of 6.15 μm.

(Rounding Step)

Subsequently, while maintaining the rotation speed, an aqueous solution obtained by mixing 20% aqueous DBS solution (6 parts in terms of solid amount) with 0.04 parts of water was added thereto over 30 minutes, during which the internal temperature was elevated to 90° C. Thereafter, the internal temperature was elevated to 101.5° C., and the resultant mixture was continuously heated and stirred under those conditions over further 1.5 hours until the average degree of circularity thereof became 0.974. The resultant mixture was then cooled to 20° C. over 50 minutes to obtain a slurry of toner base particles B. The particles of this slurry had a volume-based median diameter of 6.36 μm, a number-based median diameter of 5.94 μm, a distribution, (volume-based median diameter)/(number-based median diameter), of 1.071, and an average degree of circularity of 0.978.

(Washing/Drying Step)

The whole slurry obtained was subjected to a filtration treatment with a wet-process electromagnetic sieve shaking machine (AS200; Retsch Co., Ltd.) equipped with a sieve having an opening size of 24 μm, for the purpose of removing coarse particles. The treated slurry was temporarily placed in a tank equipped with a stirrer. Thereafter, this slurry was supplied to a horizontal centrifugal separator (Type HZ40Si; Mitsubishi Kakoki Kaisha, Ltd.) in which a filter cloth (polyester TR815c; Nakao Filter Media Corp.; thickness, 0.3 mm; air permeability, 48 (cc/cm$^2$/min)) had been mounted, and centrifugal dehydration washing was conducted under the conditions of an acceleration of 800 G. Ion-exchanged water having an electrical conductivity of 1 μS/cm was added thereto in an amount about 50 times the amount of the solid components of the slurry at such a rate that the water did not overflow the rim. As a result, the electrical conductivity of the filtrate became 2 μS/cm. Finally, the water was sufficiently removed by centrifuging, and the cake was recovered with a scraper.

The cake thus obtained was spread in a stainless-steel vat in a thickness of 20 mm and dried for 48 hours in an air-blowing drying oven set at 40° C. Thus, toner base particles B were obtained.

<External Additives>

The following external additives were used in the Examples.

Silica particles: polydimethylsiloxane-treated silica particles; average primary-particle diameter, 11 nm; BET specific surface area, 120 m$^2$/g Inorganic particles 1: titanium oxide particles; average primary-particle diameter, 0.25 μm; BET specific surface area, 15 m$^2$/g Inorganic particles 2: titanium oxide particles; average primary-particle diameter, 15 μm; BET specific surface area, 78 m$^2$/g Inorganic particles 3: hydrotalcite particles; average primary-particle diameter, 0.4 μm; BET specific surface area, 9 m$^2$/g Inorganic particles 4: zinc stearate particles; average primary-particle diameter, 0.9 μm; BET specific surface area, 10 m$^2$/g

Example 1

A sample mill (manufactured by Kyoritsu Riko Co., Ltd.) (outer diameter of the stirring blades: 128 mm) was kept heated at 40° C. beforehand. Thereafter, toner base particles A and 0.2 parts of silica particles per 100 parts by mass of the toner base particles were introduced thereinto. An external addition was subsequently conducted (first time) under the conditions shown in Table 1. Thereafter, 1.2 parts of silica particles per 100 parts by mass of the toner base particles and 0.05 parts of inorganic particles 1 per 100 parts by mass of the toner base particles were introduced to conduct an external addition (second time) under the conditions shown in Table 1. Furthermore, 0.3 parts of inorganic particles 2 per 100 parts by mass of the toner base particles, 0.05 parts of inorganic particles 3 per 100 parts by mass of the toner base particles, and 0.03 parts of inorganic particles 4 per 100 parts by mass of the toner base particles were introduced to conduct an external addition (third time) under the conditions shown in Table 1. Thus, toner A was obtained.

The toner A obtained was examined for BET specific surface area, volume-based median diameter (hereinafter referred to as particle diameter), loosened apparent density, and average transporting property. The results thereof are shown in Table 2.

(Printing Characteristics)

Furthermore, the toner A obtained was subjected to a 1,500-sheet printing test in an atmosphere having a temperature of 23° C. and a humidity of 50%, using a full-color printer which had a printing speed of 48 mm/sec, was of the non-magnetic one-component type, and employed an organic photoreceptor charged with a charging roller and in which the transfer was of the intermediate transfer belt type. No falling of toner masses from the cartridge was observed. With the toner A, satisfactory images were obtained.

Examples 2 to 4

External additions were conducted in the same manner as in Example 1, except that the conditions of external additions were changed as shown in Table 1. Thus, toner B, toner C, and toner D were obtained.

Each of the toners obtained were examined for BET specific surface area, volume-based median diameter (particle diameter), loosened apparent density, and average transporting property in the same manners as in Example 1. The results thereof are shown in Table 2.

Furthermore, 1,500-sheet printing with a full-color printer was conducted in the same manner as in Example 1. It was ascertained that each of the toners B, C, D was free from the falling of toner masses from the cartridge and gave satisfactory images.

Example 7

External additions were conducted in the same manner as in Example 1, except that the conditions of external additions were changed as shown in Table 1. Thus, toner K was obtained.

Each of the toners obtained were examined for BET specific surface area, volume-based median diameter (particle diameter), loosened apparent density, and average transporting property in the same manners as in Example 1. The results thereof are shown in Table 2.

Furthermore, 1,500-sheet printing with a full-color printer was conducted in the same manner as in Example 1. It was ascertained that the toner was free from the falling of toner masses from the cartridge and gave satisfactory images.

Example 8

External additions were conducted in the same manner as in Example 1, except that the conditions of external additions were changed as shown in Table 1. Thus, toner L was obtained.

Each of the toners obtained were examined for BET specific surface area, volume-based median diameter (particle diameter), loosened apparent density, and average transporting property in the same manners as in Example 1. The results thereof are shown in Table 2.

Furthermore, 1,500-sheet printing with a full-color printer was conducted in the same manner as in Example 1. It was ascertained that the toner was free from the falling of toner masses from the cartridge. With respect to the images, however, slight unevenness was observed on close inspection although not problematic in practical use.

Comparative Examples 1 and 2

External additions were conducted in the same manner as in Example 1, except that the conditions of external additions were changed as shown in Table 1. Thus, toner E and toner F were obtained.

Each of the toners obtained were examined for BET specific surface area, volume-based median diameter (particle diameter), loosened apparent density, and average transporting property in the same manners as in Example 1. The results thereof are shown in Table 2.

Furthermore, 1,500-sheet printing with a full-color printer was conducted in the same manner as in Example 1. With respect to the toner E and toner F, it was ascertained that the falling of toner masses from the cartridge occurred. The images were ascertained to be satisfactory.

Comparative Example 3

A sample mill (manufactured by Kyoritsu Riko Co., Ltd.) was kept heated at 40° C. beforehand. Thereafter, toner base particles A were introduced, and the mixer was rotated (first time) under the conditions shown in Table 1.

As a result, toner adhesion to the inner walls of the mixer and to the rotating shaft occurred, rendering a second external addition impossible.

TABLE 1

| | Mixer temperature (° C.) | First time | | | | Second time | | | | Third time | | | |
|---|---|---|---|---|---|---|---|---|---|---|---|---|---|
| | | External additive | Amount (parts) | Rotation speed (rpm) | Period (min) | External additive | Amount (parts) | Rotation speed | Period | External additive | Amount (parts) | Rotation speed | Period |
| Example 1 | 40 | silica particles | 0.2 | 6000 | 1 | silica particles<br>inorganic particles 1 | 1.2<br>0.05 | 6700 | 4 | inorganic particles 2<br>inorganic particles 3<br>inorganic particles 4 | 0.3<br>0.05<br>0.03 | 6700 | 2 |
| Example 2 | 40 | silica particles | 0.2 | 6000 | 1 | silica particles<br>inorganic particles 1 | 1.2<br>0.05 | 6350 | 4 | inorganic particles 2<br>inorganic particles 3<br>inorganic particles 4 | 0.3<br>0.05<br>0.03 | 6350 | 2 |
| Example 3 | 40 | silica particles | 0.2 | 6000 | 1 | silica particles<br>inorganic particles 1 | 1.2<br>0.05 | 6000 | 4 | inorganic particles 2<br>inorganic particles 3<br>inorganic particles 4 | 0.3<br>0.05<br>0.03 | 6000 | 2 |
| Example 4 | 35 | silica particles | 0.2 | 6000 | 1 | silica particles<br>inorganic particles 1 | 1.4<br>0.05 | 6000 | 4 | inorganic particles 2<br>inorganic particles 3<br>inorganic particles 4 | 0.3<br>0.05<br>0.03 | 6000 | 7 |
| Example 7 | 40 | silica particles | 0.2 | 6000 | 1 | silica particles<br>inorganic particles 1 | 1.2<br>0.05 | 6000 | 4 | inorganic particles 2<br>inorganic particles 3<br>inorganic particles 4 | 0.3<br>0.05<br>0.03 | 6000 | 7 |

TABLE 1-continued

| | Mixer temperature (° C.) | First time External additive | First time Amount (parts) | First time Rotation speed (rpm) | First time Period (min) | Second time External additive | Second time Amount (parts) | Second time Rotation speed | Second time Period | Third time External additive | Third time Amount (parts) | Third time Rotation speed | Third time Period |
|---|---|---|---|---|---|---|---|---|---|---|---|---|---|
| Example 8 | 40 | silica particles | 0.2 | 6000 | 1 | silica particles<br>inorganic particles 1 | 1.2<br>0.05 | 6000 | 4 | inorganic particles 2<br>inorganic particles 3<br>inorganic particles 4 | 0.3<br>0.05<br>0.03 | 6000 | 12 |
| Comparative Example 1 | 35 | silica particles | 0.2 | 6000 | 1 | silica particles<br>inorganic particles 1 | 1.4<br>0.05 | 6000 | 4 | inorganic particles 2<br>inorganic particles 3<br>inorganic particles 4 | 0.3<br>0.05<br>0.03 | 6000 | 5 |
| Comparative Example 2 | 35 | silica particles | 0.2 | 6000 | 1 | silica particles<br>inorganic particles 1 | 1.4<br>0.05 | 6000 | 4 | inorganic particles 2<br>inorganic particles 3<br>inorganic particles 4 | 0.3<br>0.05<br>0.03 | 6000 | 2 |
| Comparative Example 3 | 40 | — | — | 8000 | 1 | — | — | — | — | — | — | — | — |

TABLE 2

| | Toner | Particle diameter (μm) | BET ($m^2/g$) | (Particle diameter) × BET ($\times 10^{-6}$) ($m^3/g$) | Average transporting property (mg/sec) | Loosened apparent density ($g/cm^3$) | Falling of toner masses from cartridge | Image defect |
|---|---|---|---|---|---|---|---|---|
| Example 1 | A | 6.91 | 1.37 | 9.4 | 7.6 | 0.381 | not occurred | ○ |
| Example 2 | B | 6.91 | 1.42 | 9.8 | 5.4 | 0.402 | not occurred | ○ |
| Example 3 | C | 6.91 | 1.52 | 10.5 | 3.6 | 0.418 | not occurred | ○ |
| Example 4 | D | 7.17 | 1.53 | 11.0 | 4.3 | 0.425 | not occurred | ○ |
| Example 7 | K | 6.91 | 1.25 | 8.6 | 10.1 | 0.382 | not occurred | ○ |
| Example 8 | L | 6.91 | 1.12 | 7.7 | 15.1 | 0.342 | not occurred | Δ |
| Comparative Example 1 | E | 7.17 | 1.60 | 11.5 | 2.6 | 0.434 | occurred | ○ |
| Comparative Example 2 | F | 6.92 | 1.72 | 11.9 | 1.8 | 0.448 | occurred | ○ |
| Comparative Example 3 | — | — | — | — | — | — | — | — |

Example 5

A Henschel mixer (manufactured by Mitsui Mining Co., Ltd.) was kept heated at 35° C. beforehand. Thereafter, toner base particles B were introduced. Subsequently, 0.2 parts of silica particles per 100 parts by mass of the toner base particles were introduced to conduct an external addition (first time) under the conditions shown in Table 3. Thereafter, 1.2 parts of silica particles per 100 parts by mass of the toner base particles were introduced to conduct an external addition (second time) under the conditions shown in Table 3.

Furthermore, 0.4 parts of inorganic particles 2 per 100 parts by mass of the toner base particles, 0.05 parts of inorganic particles 3 per 100 parts by mass of the toner base particles, and 0.05 parts of inorganic particles 4 per 100 parts by mass of the toner base particles were introduced to conduct an external addition (third time) under the conditions shown in Table 3. Thus, toner G was obtained.

The toner G obtained was examined for BET specific surface area, volume-based median diameter (particle diameter), loosened apparent density, and average transporting property. The results thereof are shown in Table 4.

(Printing Characteristics)

Furthermore, the toner G obtained was subjected to a 3,000-sheet printing test in an atmosphere having a temperature of 23° C. and a humidity of 50%, using a full-color printer which had a printing speed of 112 mm/sec, was of the non-magnetic one-component type, and employed an organic photoreceptor charged with a charging roller and in which the transfer was of the intermediate transfer belt type. No falling of toner masses from the cartridge was observed. With the toner G, satisfactory images were obtained.

Example 6

A sample mill (manufactured by Kyoritsu Riko Co., Ltd.) (outer diameter of the stirring blades: 128 mm) was kept heated at 35° C. beforehand. Thereafter, toner base particles B were introduced. Subsequently, 0.2 parts of silica particles per 100 parts by mass of the toner base particles were introduced to conduct an external addition (first time) under the conditions shown in Table 3. Thereafter, 1.0 part of silica particles per 100 parts by mass of the toner base particles were introduced to conduct an external addition (second time) under the conditions shown in Table 3.

Furthermore, 0.4 parts of inorganic particles 2 per 100 parts by mass of the toner base particles, 0.05 parts of inorganic particles 3 per 100 parts by mass of the toner base particles, and 0.05 parts of inorganic particles 4 per 100 parts by mass of the toner base particles were introduced to conduct an external addition (third time) under the conditions shown in Table 3. Thus, toner H was obtained.

The toner H obtained was examined for BET specific surface area, volume-based median diameter (particle diameter), loosened apparent density, and average transporting property in the same manners as in Example 5. The results thereof are shown in Table 4.

Furthermore, 3,000-sheet printing with a full-color printer was conducted in the same manner as in Example 5. It was ascertained that the toner was free from the falling of toner masses from the cartridge and gave satisfactory images.

Comparative Example 4

External additions were conducted in the same manner as in Example 5, except that the conditions of external additions were changed as shown in Table 3. Thus, toner I was obtained.

The toner I obtained was examined for BET specific surface area, volume-based median diameter (particle diameter), loosened apparent density, and average transporting property in the same manners as in Example 5. The results thereof are shown in Table 4.

Furthermore, 3,000-sheet printing with a full-color printer was conducted in the same manner as in Example 5. With respect to the toner I, it was ascertained that the falling of toner masses from the cartridge occurred. The images were ascertained to be satisfactory.

Comparative Example 5

External additions were conducted in the same manner as in Example 6, except that the conditions of external additions were changed as shown in Table 3. Thus, toner J was obtained.

The toner J obtained was examined for BET specific surface area, volume-based median diameter (particle diameter), loosened apparent density, and average transporting property in the same manners as in Example 5. The results thereof are shown in Table 4.

Furthermore, 3,000-sheet printing with a full-color printer was conducted in the same manner as in Example 5. With respect to the toner J, it was ascertained that the falling of toner masses from the cartridge occurred. The images were ascertained to be satisfactory.

TABLE 3

| | Mixer | First time | | | | Second time | | | | Third time | | | |
|---|---|---|---|---|---|---|---|---|---|---|---|---|---|
| | temperature (° C.) | External additive | Amount (parts) | Rotation speed (rpm) | Period (min) | External additive | Amount (parts) | Rotation speed | Period | External additive | Amount (parts) | Rotation speed | Period |
| Example 5 | 35 | silica particles | 0.2 | 1650 | 2 | silica particles | 1.2 | 1600 | 10 | inorganic particles 2 | 0.4 | 1600 | 5 |
| | | | | | | | | | | inorganic particles 3 | 0.05 | | |
| | | | | | | | | | | inorganic particles 4 | 0.05 | | |
| Example 6 | 35 | silica particles | 0.2 | 6000 | 3 | silica particles | 1.0 | 6000 | 6 | inorganic particles 2 | 0.4 | 6000 | 3 |
| | | | | | | | | | | inorganic particles 3 | 0.05 | | |
| | | | | | | | | | | inorganic particles 4 | 0.05 | | |
| Comparative Example 4 | 35 | silica particles | 0.2 | 1650 | 2 | silica particles | 1.4 | 1400 | 10 | inorganic particles 2 | 0.4 | 1400 | 5 |
| | | | | | | | | | | inorganic particles 3 | 0.05 | | |
| | | | | | | | | | | inorganic particles 4 | 0.05 | | |
| Comparative Example 5 | 35 | silica particles | 0.2 | 6000 | 1 | silica particles | 1.4 | 6000 | 4 | inorganic particles 2 | 0.4 | 6000 | 2 |
| | | | | | | | | | | inorganic particles 3 | 0.05 | | |
| | | | | | | | | | | inorganic particles 4 | 0.05 | | |

TABLE 4

| | Toner | Particle diameter (μm) | BET ($m^2/g$) | (Particle diameter) × BET ($\times 10^{-6}$) ($m^3/g$) | Average transporting property (mg/sec) | Loosened apparent density ($g/cm^3$) | Falling of toner masses from cartridge | Image defect |
|---|---|---|---|---|---|---|---|---|
| Example 5 | G | 6.33 | 1.74 | 11.0 | 2.9 | 0.419 | not occurred | ○ |
| Example 6 | H | 6.49 | 1.48 | 9.6 | 5.3 | 0.418 | not occurred | ○ |
| Comparative Example 4 | I | 6.54 | 2.01 | 13.1 | 2.0 | 0.429 | occurred | ○ |
| Comparative Example 5 | J | 6.33 | 2.31 | 14.6 | 1.3 | 0.429 | Occurred | ○ |

While the invention has been described in detail and with reference to specific embodiments thereof, it will be apparent to one skilled in the art that various changes and modifications can be made therein without departing from the spirit and scope thereof.

This application is based on a Japanese patent application filed on Mar. 29, 2012 (Application No. 2012-76125), the contents thereof being incorporated herein by reference.

DESCRIPTION OF THE REFERENCE NUMERALS

1 Toner
2 Charging blade (charging member)
3 Developing roller
4 Retaining blade
5 Charging roller
6 Wiper blade
7 Electrophotographic photoreceptor
8 Toner cartridge
9 Intermediate transfer belt
10 Transfer roller
11 Retaining blade
12 Developing roller
13 Toner
14 Feed roller
15 Stirring blade
16 Charging blade (charging member)
17 Electrophotographic photoreceptor
18 Wiper blade
19 Charging roller
20 Toner cartridge
21 Intermediate transfer belt
22 Transfer roller

The invention claimed is:

1. A toner cartridge comprising:

a toner for electrostatic-image development, satisfying the following requirements (1) and (2);

a developing roller for supporting the toner for electrostatic-image development thereon;

a charging blade disposed on the upper side of the developing roller; and a retaining blade disposed on the lower side of the developing roller so as to face the developing roller at a predetermined distance:

(1) the toner has an average transporting property of 2.9 to 15.1 mg/sec; and (2) the product of the BET specific surface area ($m^2/g$) and volume-average particle diameter (μm) of the toner is $7.7\times10^{-6}$ to $11.0\times10^{-6}$ ($m^3/g$), wherein the toner for electrostatic-image development has a loosened apparent density of 0.342 to 0.425 $g/cm^3$.

2. The toner cartridge according to claim 1, wherein the toner for electrostatic-image development has a loosened apparent density of 0.380 to 0.425 $g/cm^3$.

* * * * *